US010252116B2

(12) United States Patent
Marton et al.

(10) Patent No.: US 10,252,116 B2
(45) Date of Patent: Apr. 9, 2019

(54) VIBRATING FITNESS BALL

(71) Applicant: Hyper Ice, Inc., Irvine, CA (US)

(72) Inventors: Robert Marton, Yorba Linda, CA (US); Anthony Katz, Laguna Niguel, CA (US)

(73) Assignee: Hyper Ice, Inc., Irvine, CA (US)

( * ) Notice: Subject to any disclaimer, the term of this patent is extended or adjusted under 35 U.S.C. 154(b) by 283 days.

(21) Appl. No.: 15/252,840

(22) Filed: Aug. 31, 2016

(65) Prior Publication Data

US 2017/0106249 A1 Apr. 20, 2017

Related U.S. Application Data

(60) Provisional application No. 62/243,126, filed on Oct. 18, 2015.

(51) Int. Cl.
*A61H 15/00* (2006.01)
*A61H 23/02* (2006.01)
(Continued)

(52) U.S. Cl.
CPC ..... *A63B 43/004* (2013.01); *A61H 15/0092* (2013.01); *A61H 23/02* (2013.01);
(Continued)

(58) Field of Classification Search
None
See application file for complete search history.

(56) References Cited

U.S. PATENT DOCUMENTS 5,297,981 A * 3/1994 Maxim ..... A63H 33/005 446/437
5,389,063 A 2/1995 Wu
(Continued)

FOREIGN PATENT DOCUMENTS

CN 204334213 U 5/2015
DE 9200901.8 U1 7/1992
(Continued)

OTHER PUBLICATIONS

English language machine translation of Korean Unexamined Publication No. 20-2008-0004947 published Oct. 28, 2008, 8 pp. (not prior art).
(Continued)

*Primary Examiner* — Sundhara M Ganesan
(74) *Attorney, Agent, or Firm* — Patterson Intellectual Property Law, P.C.; Jerry Turner Sewell

(57) ABSTRACT

A fitness ball has first and second hemispheres, which are connectable to form a complete sphere. The first hemisphere supports a motor having a pair of rotatable eccentric masses at opposite ends of a common drive shaft. The second hemisphere supports a rechargeable battery pack, electronic circuitry and indicators LEDs. The electronic circuit controls the charging of the battery pack and also selectively provides electrical power from the battery pack to the motor to control the rotational speed of the motor to rotate the eccentric masses. The rotating eccentric masses cause vibrations that are communicated from the motor to the two hemispheres. The vibration frequency is controlled by the rotational speed of the motor. The hemispheres have outer covers having a configuration that is easy to grip such that the vibrations are communicated to a users hands. The ball is substantially balanced about an equatorial plane.

20 Claims, 29 Drawing Sheets

(51) Int. Cl.

| | |
|---|---|
| ***A63B 21/00*** | (2006.01) |
| ***A63B 23/12*** | (2006.01) |
| ***A63B 24/00*** | (2006.01) |
| ***A63B 43/00*** | (2006.01) |

(52) U.S. Cl.

CPC ..... *A61H 23/0254* (2013.01); *A63B 21/0004* (2013.01); *A63B 21/00178* (2013.01); *A63B 24/0087* (2013.01); *A61H 2015/0042* (2013.01); *A61H 2015/0071* (2013.01); *A61H 2023/029* (2013.01); *A61H 2023/0281* (2013.01); *A61H 2201/0192* (2013.01); *A61H 2201/1261* (2013.01); *A61H 2201/1284* (2013.01); *A61H 2201/164* (2013.01); *A61H 2201/1619* (2013.01); *A61H 2201/1623* (2013.01); *A61H 2201/1628* (2013.01); *A61H 2201/1669* (2013.01); *A61H 2201/5005* (2013.01); *A61H 2201/5035* (2013.01); *A63B 21/00196* (2013.01); *A63B 23/1245* (2013.01); *A63B 2207/02* (2013.01); *A63B 2213/00* (2013.01); *A63B 2225/50* (2013.01)

(56) References Cited

U.S. PATENT DOCUMENTS

| | | | | |
|---|---|---|---|---|
| 5,413,551 | A * | 5/1995 | Wu | A61H 15/00 601/131 |
| 5,554,102 | A | 9/1996 | Chiou | |
| D421,078 | S | 2/2000 | Weiss, Jr. | |
| 6,432,071 | B1 | 8/2002 | Hsieh | |
| D472,643 | S | 4/2003 | Zake | |
| 6,694,550 | B2 | 2/2004 | Lee | |
| D625,426 | S | 10/2010 | Robins | |
| 8,002,682 | B2 | 8/2011 | Dye | |
| 8,337,437 | B2 | 12/2012 | Hitzmann | |
| 8,500,663 | B2 | 8/2013 | Godfrey | |
| 8,556,837 | B1 | 10/2013 | Poirer | |
| D694,421 | S | 11/2013 | Anderson | |
| D695,371 | S | 12/2013 | Hedeen, Jr. | |
| D724,161 | S | 3/2015 | Kühne | |
| 9,616,279 | B2 | 4/2017 | Jones | |
| 9,833,650 | B2 | 12/2017 | Jones | |
| 2003/0131416 | A1 | 7/2003 | Lee | |
| 2004/0138595 | A1 | 7/2004 | Fang | |
| 2004/0249322 | A1 | 12/2004 | Cohen | |
| 2005/0070827 | A1 | 3/2005 | Lee | |
| 2009/0176635 | A1 | 7/2009 | Brinson | |
| 2013/0267396 | A1 | 10/2013 | Dye | |
| 2013/0281892 | A1 | 10/2013 | Godfrey et al. | |
| 2013/0331745 | A1 | 12/2013 | Sedic | |
| 2014/0163437 | A1* | 6/2014 | Mack | A61H 19/30 601/46 |
| 2014/0194258 | A1 | 7/2014 | Shorter | |
| 2015/0119770 | A1* | 4/2015 | Driscoll | A61H 23/02 601/48 |

FOREIGN PATENT DOCUMENTS

| | | | |
|---|---|---|---|
| DE | 102006058876 | A1 | 10/2007 |
| DE | 202014004900 | U1 | 10/2014 |
| DE | 202014004901 | U1 | 10/2014 |
| DE | 102014211779 | A1 | 12/2015 |
| DE | 102014211780 | A1 | 12/2015 |
| DE | 102015002235 | A1 | 12/2015 |
| KR | 20-2008-0004947 | U | 10/2008 |

OTHER PUBLICATIONS

International Search Report in corresponding International Application No. PCT/US2016/057317 dated Jan. 11, 2017, 13 pp. (not prior art).

Amazon customer reviews for Hyperice Hypersphere 3 Speed Localized Vibration Therapy Ball.

* cited by examiner

VIBRATING FITNESS BALL

RELATED APPLICATIONS

The present application claims the benefit of priority under 35 USC § 119(e) from U.S. Provisional Application No. 62/243,126 filed on Oct. 18, 2015, for "Vibrating Fitness Ball," which is hereby incorporated herein by reference.

FIELD OF THE INVENTION

The present invention is in the field of therapeutic devices, and, more particularly, is in the field of exercise and fitness balls for massaging and toning muscles.

BACKGROUND OF THE INVENTION

Holding vibrating equipment as part of a fitness or therapeutic regimen has been found to provide benefits to enhance joint stability and to improve overall neuromuscular control. For example, vibrating dumbbells are available for this purpose. The configuration of vibrating dumbbells limits the utility of such devices because the devices must be gripped securely using the cylindrical bar interconnecting the two end weights. Such devices also do not vibrate with sufficient force to provide the desirable benefits of vibration. Vibrating rollers are used for therapeutic massage; however, rollers typically spread the vibrations over relatively large areas of a body and do not allow the vibratory effect to be concentrated in smaller areas to focus the therapeutic effect on a particular muscle or myofascial connective tissue.

SUMMARY OF THE INVENTION

A need exists for a vibrating exercise device having a configuration that is easy to grip and hold and which provides vibrations of sufficient strength to cause the vibrations to be communicated from a user's hands to the user's arms and shoulders. A need also exists for a device that can also be used as a therapeutic massage device.

One aspect of the embodiments disclosed herein is a fitness ball having first and second hemispheres, which are connectable to form a complete sphere. The first hemisphere supports a motor having a pair of rotatable eccentric masses at opposite ends of a common drive shaft. The second hemisphere supports a rechargeable battery pack, electronic circuitry and indicators LEDs. The electronic circuit controls the charging of the battery pack and also selectively provides electrical power from the battery pack to the motor to control the rotational speed of the motor to rotate the eccentric masses. The rotating eccentric masses cause vibrations that are communicated from the motor to the two hemispheres. The vibration frequency is controlled by the rotational speed of the motor. The hemispheres have outer covers having a configuration that is easy to grip such that the vibrations are communicated to a user's hands. The ball is substantially balanced about an equatorial plane.

Another aspect of the embodiments disclosed herein is portable vibration generation apparatus. The apparatus comprises a first hemispherical shell and a second hemispherical shell. The first hemispherical shell has an outer surface and an inner surface. The inner surface of the first hemispherical shell includes at least one motor support structure. The second hemispherical shell has an outer surface and an inner surface. The inner surface of the second hemispherical shell includes at least one battery support structure and at least one circuit board support structure. The second hemispherical shell is mechanically coupleable to the first hemispherical at an equatorial plane to form a spherical ball. A motor is positioned on the motor support structure of the first hemispherical shell and is secured to the motor support structure to inhibit movement of the motor with respect to the motor support structure. The motor has a shaft having a first end and a second end. A first eccentric mass is secured to the first end of the shaft; and a second eccentric mass is secured to the second end of the shaft. A battery assembly is secured to the battery support structure of the second hemispherical shell. A circuit board assembly is secured to the circuit board support structure of the second hemispherical shell. The circuit board assembly is electrically connected to the battery assembly to receive electrical energy from the battery assembly. The circuit board assembly generates a motor drive signal. The vibration generation apparatus further includes at least a first electrical connector and at least a second electrical connector. The first and second electrical connectors are engageable when the first hemispherical shell is coupled to the second hemispherical shell. The connectors communicate the motor drive signal from the circuit board assembly to the motor. In certain embodiments, the motor is positioned in the first hemispherical shell; and the battery assembly and the circuit board assembly are positioned in the second hemispherical shell such that the center of gravity of the spherical ball is near the equatorial plane. In certain embodiments, the vibration generation apparatus includes a first outer cover positioned over the first hemispherical shell and a second outer cover positioned over the second hemispherical shell. In certain embodiments, the first hemispherical shell and the first outer cover include respective patterns of interlocking features that inhibit movement of the first outer cover with respect to the first hemispherical shell when the first outer cover is positioned on the first hemispherical shell; and the second hemispherical shell and the second outer cover include respective patterns of interlocking features that inhibit movement of the second outer cover with respect to the second hemispherical shell when the second outer cover is positioned on the second hemispherical shell. In certain embodiments, the portable vibration generation apparatus further includes a manually actuatable switch. The circuit board assembly is responsive to actuation of the switch to select an operational mode for the motor. The circuit board assembly selectively drives the motor at a first rotational speed in a first operational mode to cause the eccentric masses to produce vibration at a first frequency. The circuit board assembly selectively drives the motor at a second rotational speed in a second operational mode to cause the eccentric masses to produce vibration at a second frequency. In certain embodiments, the circuit board assembly selectively drives the motor at a third rotational speed in a third operational mode to cause the eccentric masses to produce vibration at a third frequency. In certain embodiments, the first hemispherical shell and the second hemispherical shell include mating alignment features that engage to cause the first hemispherical shell and the second hemispherical shell to be mutually aligned at respective mating surfaces; the first hemispherical shell includes a first connector support that positions the first electrical connector in a respective fixed known position in the first hemispherical shell; the second hemispherical shell includes a second connector support that positions the second electrical connector in a respective fixed known position in the second hemispherical shell; and the first connector support and the second connector support are mutually aligned such that when the mating alignment features are engaged, the first electrical connector engages the second electrical connector to electrically interconnect the motor and the circuit board assembly. In certain embodiments, the first hemispherical shell includes a power adapter jack configured to selectively receive a power adapter plug from a source of electrical energy; the first hemispherical shell includes a third electrical connector electrically connected to the power adapter jack; the second hemispherical shell includes a fourth electrical connector electrically connected to the circuit board assembly; the first hemispherical shell includes a third connector support that positions the third electrical connector in a respective fixed known position in the first hemispherical shell; and the second hemispherical shell includes a fourth connector support that positions the fourth electrical connector in a respective fixed known position in the second hemispherical shell. The third connector support and the fourth connector support are mutually aligned such that when the mating alignment features are engaged, the fourth electrical connector engages the third electrical connector to electrically interconnect the power adapter jack and the circuit board assembly.

Another aspect of the embodiments disclosed herein is a vibrating ball. The vibrating ball comprises a first hemispherical shell that houses an electric motor having a shaft having a first end and a second end. The electric motor has a power input. A first eccentric mass is secured to the first end of the shaft. A second eccentric mass is secured to the second end of the shaft. A first electrical connector is electrically connected to the power input of the electric motor. The vibrating ball further includes a second hemispherical shell that houses a battery and a control circuit assembly that receives power from the battery and that generates motor control signals on a motor control output. The second hemispherical shell further houses a second electrical connector electrically connected to the motor control circuit to receive the motor control signals on the motor control output. The second electrical connector is configured to mate with the first electrical connector. The vibrating ball further includes a plurality of fasteners to mechanically interconnect the first hemispherical shell to the second hemispherical shell. The first connector engages the second connector when the first hemispherical shell is connected to the second hemispherical shell to electrically connect the motor control output of the motor control circuit to the power input of the electric motor.

In certain embodiments, the first hemispherical shell includes a plurality of alignment features; and the second hemispherical shell includes a corresponding plurality of mating alignment features. The alignment features of the two hemispherical shells engage when the first and second hemispherical shells are attached. The alignment of the alignment features cause the first connector to align with the second connector. In certain embodiments, the first hemispherical shell includes a power adapter jack connectable to a source of electrical power; and includes a third electrical connector electrically connected to the power adapter jack. In such embodiments, the second hemispherical shell includes a fourth electrical connector electrically connected to the control circuit assembly. The fourth electrical connector is configured to mate with the third electrical connector. The control circuit assembly is responsive to power received from the power adapter jack via the third and fourth electrical connectors to selectively charge the battery. In certain embodiments, the second hemispherical shell further includes a plurality of light-emitting diodes electrically connected to the control circuit assembly. Each light-emitting diode is selectively activated by the control circuit assembly to indicate the status of the vibrating ball. In certain embodiments, a first outer cover positioned over the first hemispherical shell, and a second outer cover positioned over the second hemispherical shell. In certain such embodiments, the first hemispherical shell and the first outer cover include respective patterns of interlocking features that inhibit movement of the first outer cover with respect to the first hemispherical shell when the first outer cover is positioned on the first hemispherical shell. Similarly, the second hemispherical shell and the second outer cover include respective patterns of interlocking features that inhibit movement of the second outer cover with respect to the second inner shell when the second outer cover is positioned on the second hemispherical shell.

Another aspect of the embodiments disclosed herein is a method for constructing a vibrating ball. The method comprises securing an electric motor in a first hemispherical shell. The electric motor includes a shaft having first and second end portions extending from respective first and second ends of the motor. Each end portion of the shaft has a respective eccentric mass secured thereto. The electric motor is electrically connected to a first electrical connector. The method further includes securing a control circuit assembly and a battery in a second hemispherical shell. The control circuit assembly is electrically connected to receive power from the battery. The control circuit assembly is configured to provide motor control signals to a second electrical connector. The second electrical connector is configured to selectively mate with the first electrical connector. The method further comprises securing the second hemispherical shell to the first hemispherical shell with the second electrical connector mated with the first electrical connector to thereby electrically interconnect the motor to the control circuit assembly.

BRIEF DESCRIPTIONS OF THE DRAWINGS

The foregoing aspects and other aspects of the disclosure are described in detail below in connection with the accompanying drawings in which.

DESCRIPTION OF ILLUSTRATED EMBODIMENTS

Figure 1:
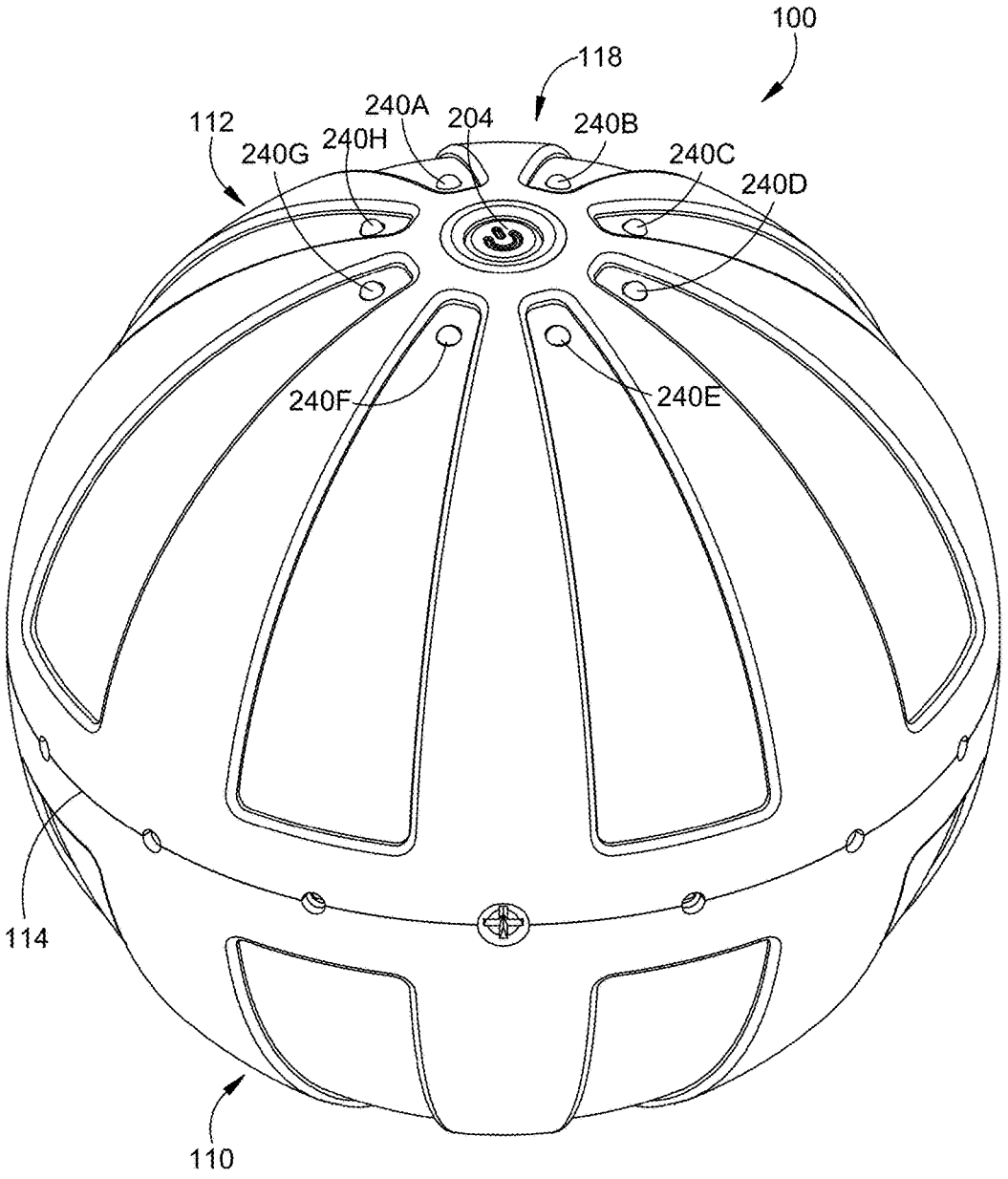
FIG. 1 illustrates a top perspective view of a vibrating fitness ball, the view showing a control button at the top of the ball and further showing a plurality of indicator light-emitting diodes (LEDs) surrounding the control button.
Figure 2:
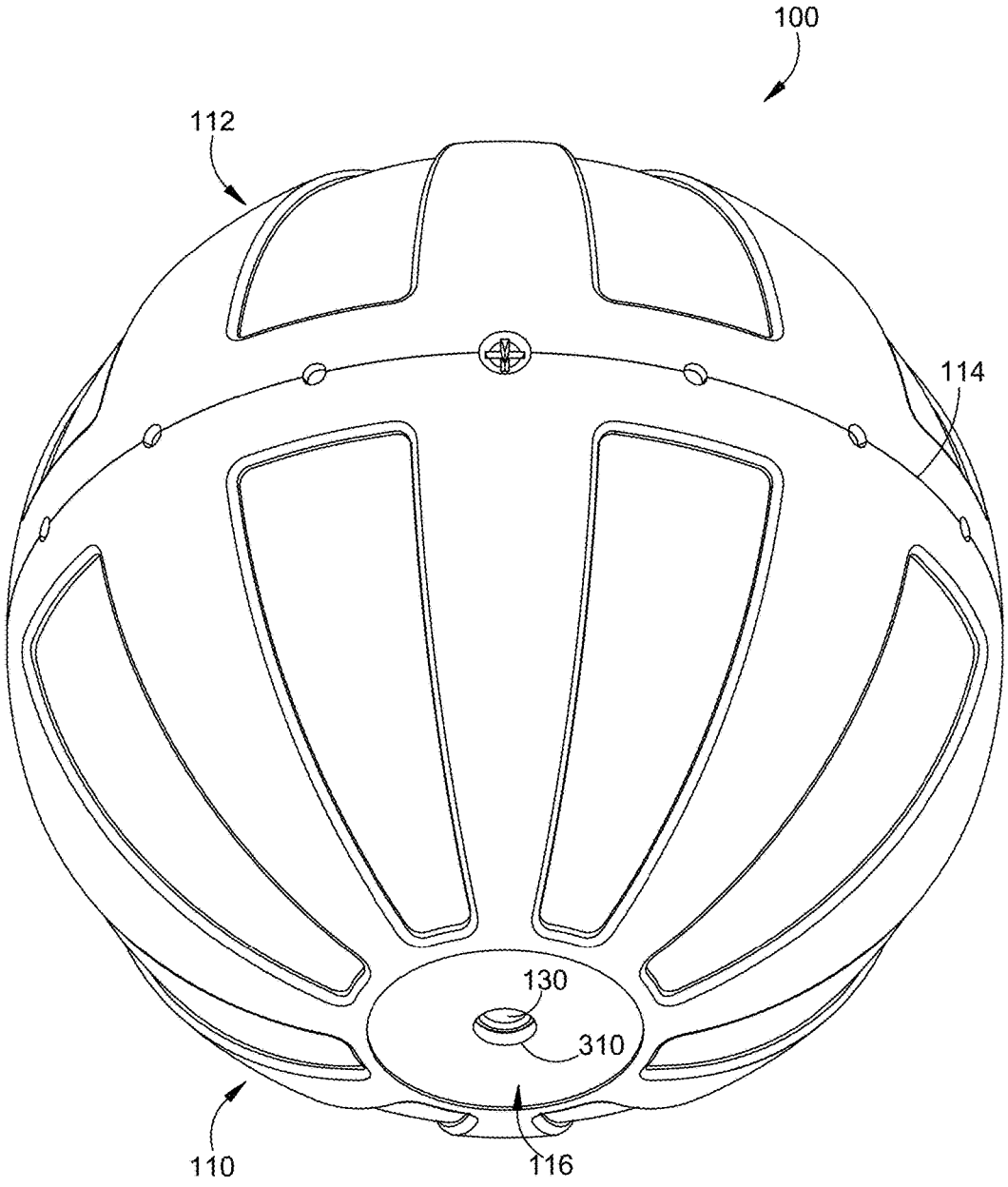
FIG. 2 illustrates a bottom perspective view of the vibrating fitness ball of FIG. 1, the view showing a power adapter port at the lower end of the ball.

A spherical fitness ball 100 is illustrated in a top perspective view in FIG. 1 and in a bottom perspective view in FIG. 2. The ball includes a lower (first) hemisphere 110 and an upper (second) hemisphere 112. The lower hemisphere and the upper hemisphere are joined along an equatorial plane 114. The portion of the lower hemisphere farthest from the equatorial plane is referred to herein as a lower pole 116 of the fitness ball. The portion of the upper hemisphere farthest from the equatorial plane is referred to herein as an upper pole 118 of the fitness ball.

Figure 3A:
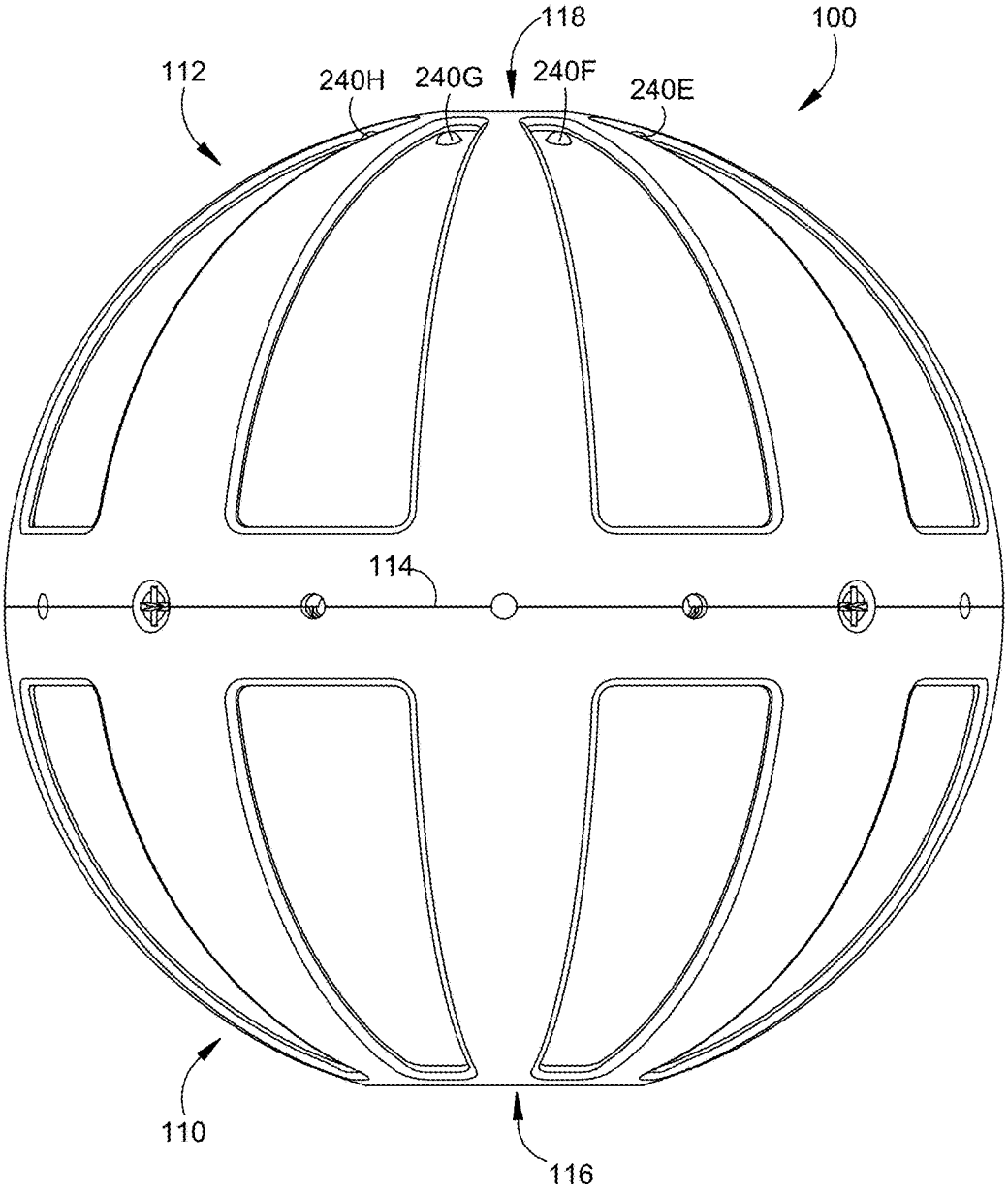
FIG. 3A illustrates a front elevational view of the vibrating fitness ball of FIG. 1.
Figure 3B:
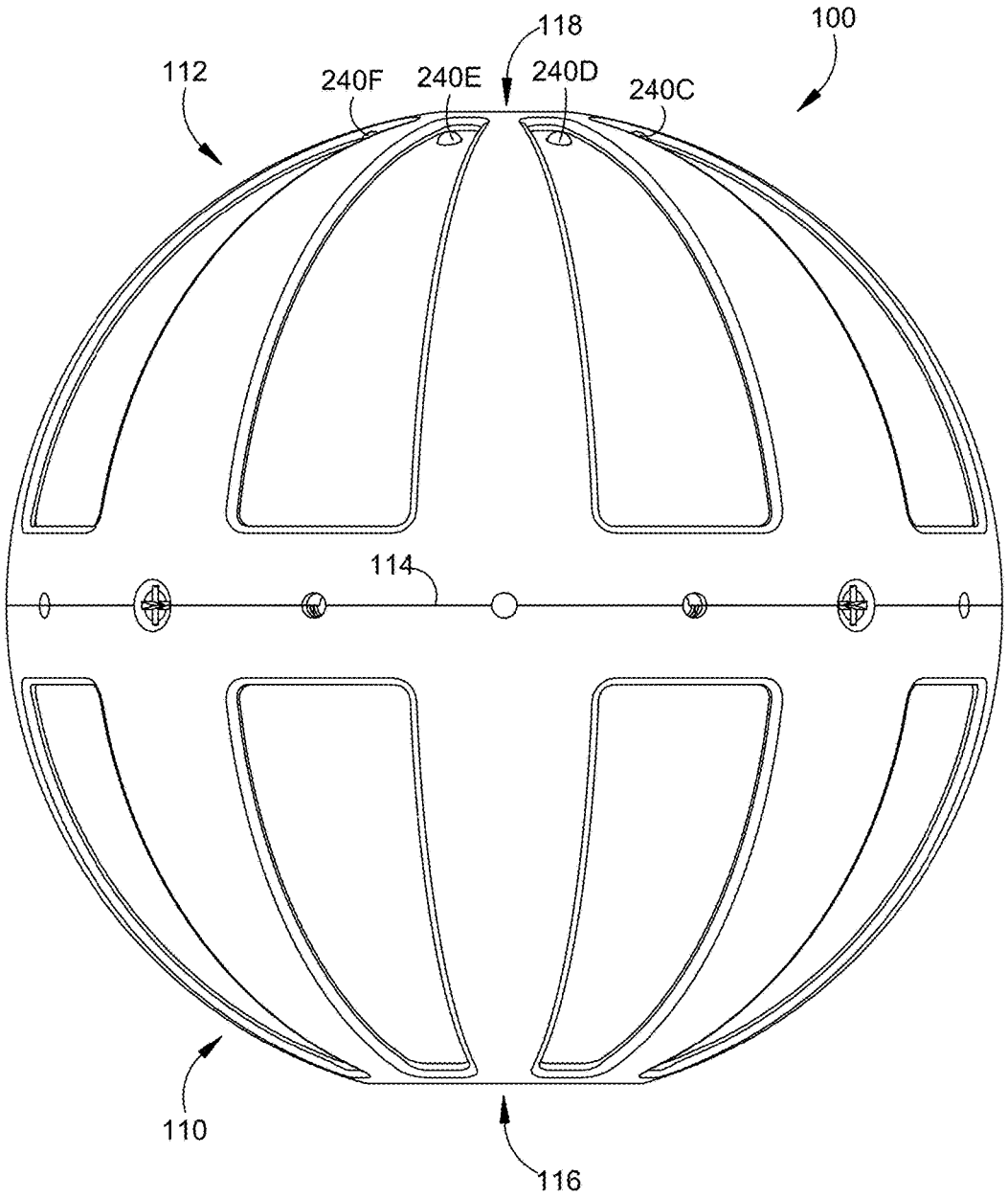
FIG. 3B illustrates a right side elevational view of the vibrating fitness ball of FIG. 1.
Figure 3C:
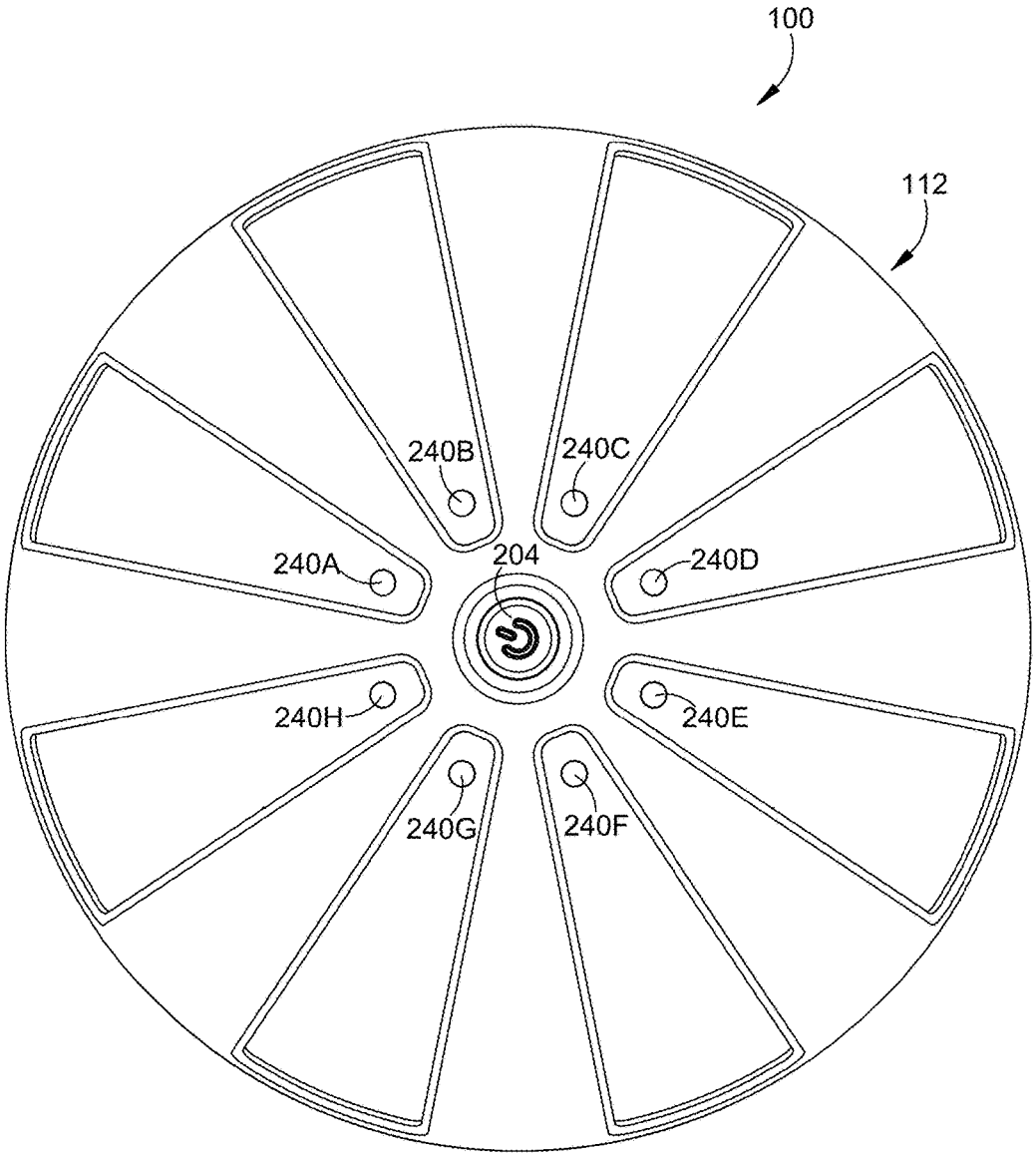
FIG. 3C illustrates a top plan view of the vibrating fitness ball of FIG. 1.
Figure 3D:
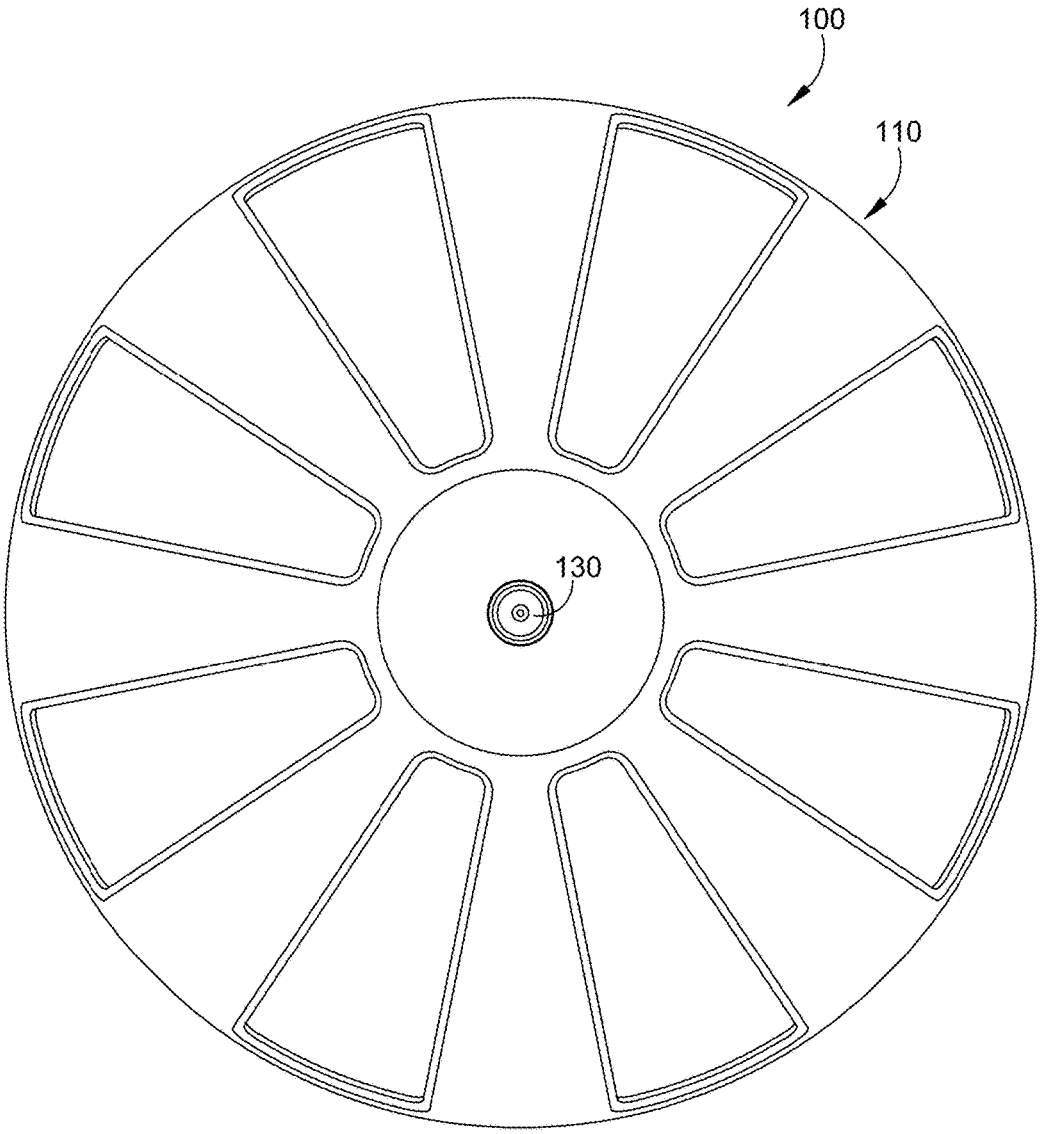
FIG. 3D illustrates a bottom plan view of the vibrating fitness ball of FIG. 1.

The outer features of the fitness ball 100 are illustrated in a front elevational view in FIG. 3A, in a side elevational view in FIG. 3B, in a top plan view in FIG. 3C, and in a bottom plan view in FIG. 3D. In the illustrated embodiment, the fitness ball has a diameter of approximately 5 inches, and is slightly flattened at the upper pole 118 and at the lower pole 116 of the ball. The diameter may be varied in alternative embodiments. For example, the diameter may range from 3 inches to 6 inches in other embodiments.

Figure 4:
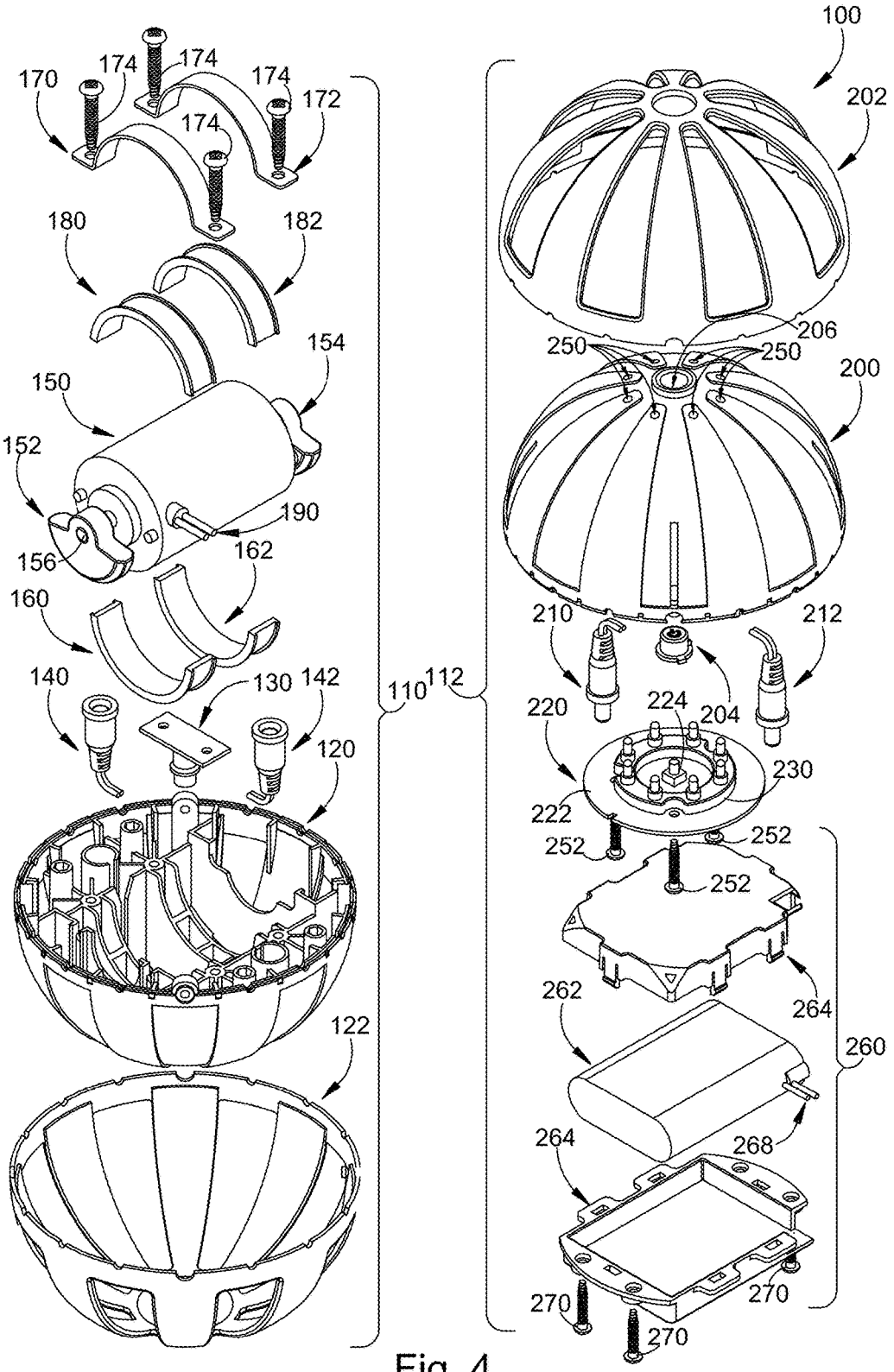
FIG. 4 illustrates an exploded view of the fitness ball of FIG. 1 showing the components of the lower hemisphere on the left and showing the components of the upper hemisphere on the right.

FIG. 4 illustrates an exploded view of the components of the fitness ball (sphere) 100. As shown on the left in FIG. 4, the lower hemisphere 110 includes a rigid, semi-hemispherical, lower inner shell 120 and a flexible lower outer cover 122.

The lower hemisphere 110 further includes a power adapter jack assembly 130 positioned through an opening (through bore) 132 (see FIG. 9) in the lower inner shell 120 at the lower pole 116 of the sphere.

The lower hemisphere 110 further includes a first barrel jack 140 and a second barrel jack 142. The two barrel jacks are shown in an enlarged view in FIG. 5. Each barrel jack has respective integral wiring pigtails 144, which are shown truncated in FIGS. 4 and 5 and in other figures. The conductors from the barrel jacks are routed among the other components and are connected in a conventional manner in accordance with an electrical schematic diagram described below with respect to FIG. 28. For example, the first barrel jack is electrically connected to the power adapter jack assembly 130. It should be appreciated that the barrel jacks described herein are interchangeable with the barrel plugs (described below).

The lower hemisphere 110 further includes an electric motor 150 having a cylindrical profile. A first eccentric mass 152 and a second eccentric mass 154 are coupled to the motor at opposite ends of the motor on a common motor shaft 156. The motor is positioned in the lower inner shell 120 with a first lower arcuate bushing 160 and a second lower arcuate bushing 162 positioned between the motor and the structure of the lower inner shell. The motor is secured to the lower inner shell by a first arcuate strap 170 and a second arcuate strap 172. The arcuate straps are fastened to the lower inners shell by a plurality of screws 174 (e.g., four screws). A respective first arcuate upper bushing 180 and a respective second arcuate upper bushing 182 are positioned between the straps and the motor. In the illustrated embodiment, each of the upper and lower bushings comprises compressible rubber or another suitable elastomeric material. When the motor is secured to the lower inner shell, the bushings are compressed to assure that the motor is fixedly attached to the lower inner shell such that the motor does not move with respect to the lower inner shell. The motor further includes two power wires 190 that are connected to the second barrel jack 142 as shown in the schematic diagram in FIG. 28.

As shown on the right in FIG. 4, the upper hemisphere 112 includes a rigid, semi-hemispherical, upper inner shell 200 and a flexible upper outer cover 202. The upper hemisphere further includes a switch actuator 204. When the upper hemisphere is assembled, the switch actuator is inserted through a central bore 206 of the upper inner shell at the upper pole 118.

The upper hemisphere 112 further includes a first barrel plug 210 and a second barrel plug 212. The barrel plugs are shown in an enlarged view in FIG. 6. Each barrel plug has respective integral wiring pigtails 214, which are shown truncated in FIGS. 4 and 6 and in other figures. The conductors from the barrel plugs are routed among the other components and are connected to a circuit board assembly (described below) in a conventional manner in accordance with the electrical schematic diagram described below with respect to FIG. 28. When the upper hemisphere is coupled to the lower hemisphere 110 as described below, the first barrel plug engages the first barrel jack 140 to electrically connect the power adapter jack assembly 130 to the circuit board assembly; and the second barrel plug engages the second barrel jack 142 to electrically connect the electric motor 150 to the circuit board assembly.

Figure 13:
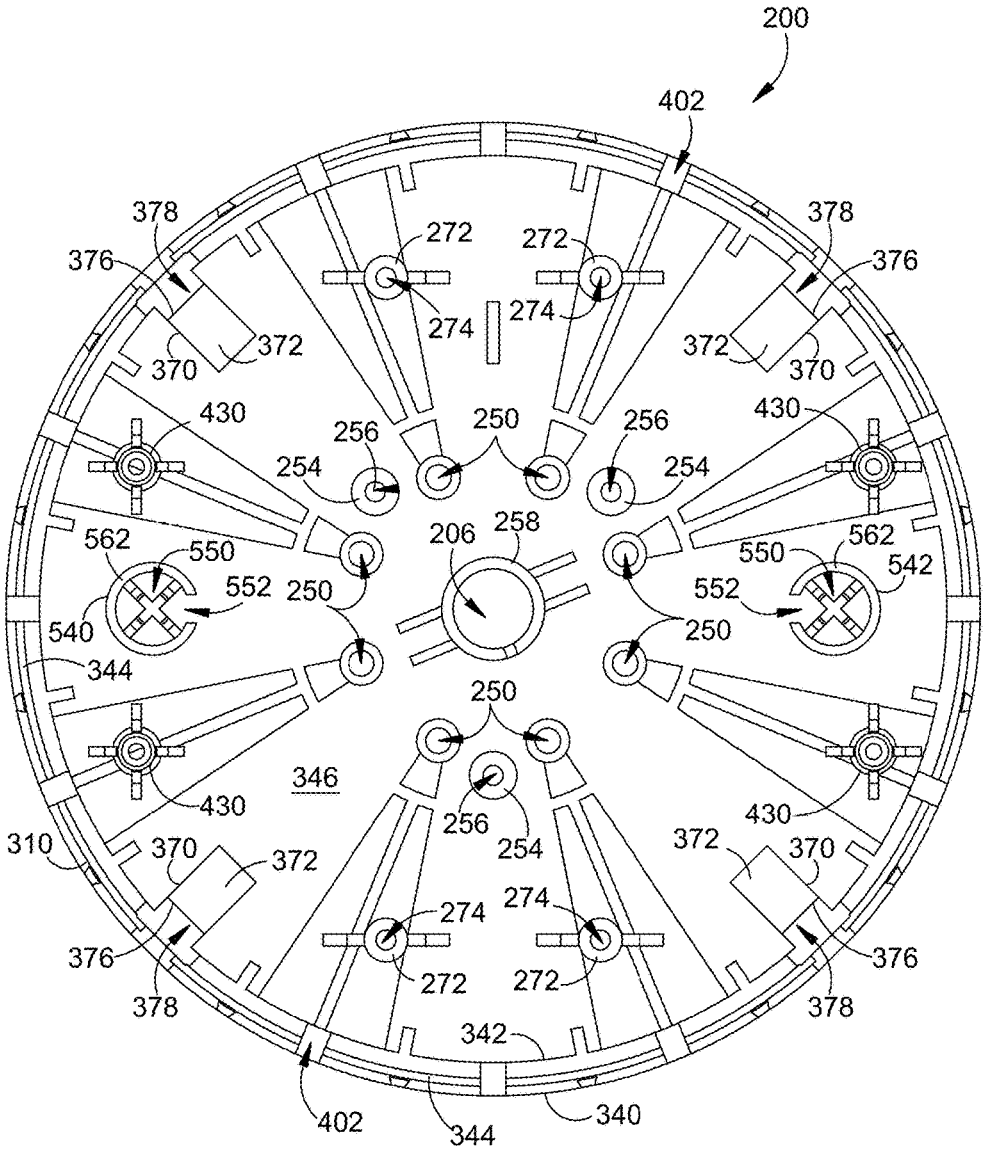
FIG. 13 illustrates a bottom plan view of the upper inner shell of FIGS. 11 and 12.

The upper hemisphere 112 further includes a circuit board assembly 220. As shown in an enlarged view in FIG. 5, the circuit board assembly includes a circular printed circuit board (PCB) 222. A pushbutton switch 224 is mounted to the center of the PCB and is aligned with the switch actuator 204. When the upper hemisphere is assembled, the switch actuator is mechanically coupled to the pushbutton switch to selectively actuate the pushbutton switch when the actuator is manually engaged. An LED support ring 230 is mounted to the PCB and is centered on the PCB. A plurality of light-emitting diodes (LEDs) 240A-H (e.g., eight LEDs) are mounted on the support ring and are electrically connected to the PCB. The LEDs are equally spaced (e.g., spaced angularly apart at 45-degree intervals) about the center of the support ring and thus about the center of the PCB. The eight LEDs are aligned with a corresponding plurality of through bores 250 in the upper inner shell 200. The through bores surround the central bore 206. The circuit board assembly is secured to the upper inner shell by a plurality of screws 252 (e.g., three screws). The screws engage bores 256 in a corresponding plurality of PCB support posts 254 (FIG. 13). When the PCB is secured to the upper inner shell, each LED extends through a respective one of the through bores. In the illustrated embodiment, the LED 240A emits red light when activated; the LEDs 240B-E emit green light when activated; and the LEDs 240E-H emit blue light when activated. Additional or fewer LEDs and different color indications can also be used. The central bore in the upper inner shell is surrounded by a circular ridge structure 258 (FIG. 13) that receives the switch actuator 204.

The upper hemisphere 112 further includes a battery assembly 260, which includes a battery cell pack 262 housed between a battery compartment base 264 and a battery compartment cover 266. Two conductors 268 extend from the battery cell pack and are electrically connected to the printed circuit board 222 in a conventional manner. The battery compartment base and the battery compartment cover snap together. The battery assembly is secured to the upper inner shell by a plurality of screws 270 (e.g., four screws). The screws engage bores 274 in a corresponding plurality of battery support posts 272 (FIG. 13).

In the illustrated embodiment, the battery cell pack 262 of the battery assembly 260 includes three battery cells (not shown), which are electrically connected in series. For example, in one embodiment, each battery cell comprises a 3.7-volt lithium-ion battery such that the battery pack provides a nominal output voltage of 11.1 volts. Such battery packs are commercially available from a number of sources and are often identified as 12-volt battery packs. In one embodiment, the battery pack has a storage capacity of approximately 2,600 milliamp-hours (mAh).

In the illustrated embodiment, the lower inner shell 120 and the upper inner shell 200 are created using a commercially available ABS material or other suitable rigid plastic material. For example, the plastic material is injection molded to produce the hemispherical outside shapes and to produce the internal support structures shown in FIGS. 8 and 10 for the lower inner shell and shown in FIGS. 11 and 13 for the upper inner shell. The lower outer cover 122 and the upper outer cover 202 are created using a commercially available thermoplastic elastomer (TPE) that provides a textured soft grip polymer skin so that the fitness ball is easily gripped by a user. In certain embodiments, the outer covers are colored and designed to provide a pleasing aesthetic appearance.

Figure 8:
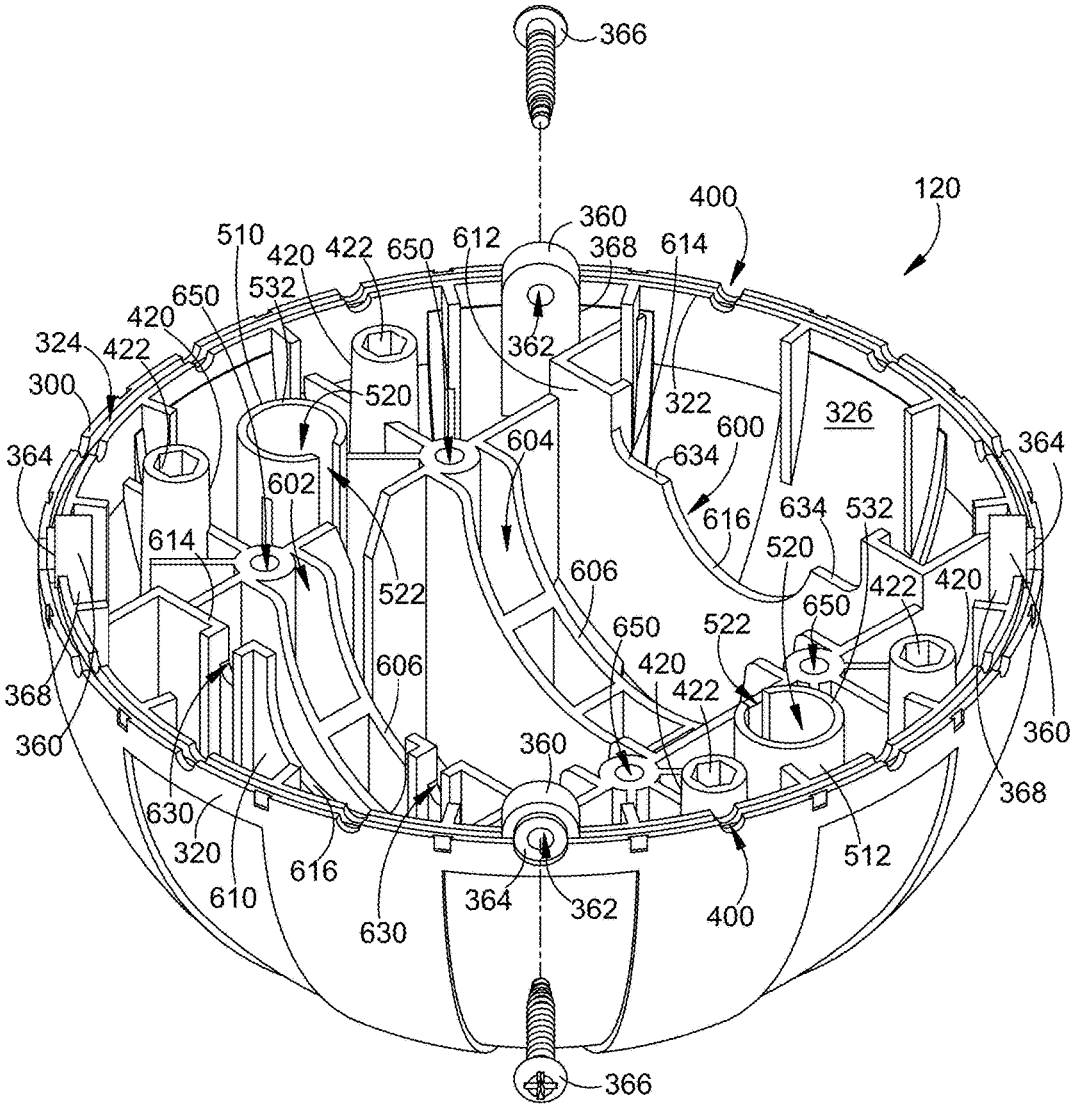
FIG. 8 illustrates a top perspective view of the inside of the lower inner shell of the fitness ball of FIG. 1 showing interconnection and mounting structures.
Figure 11:
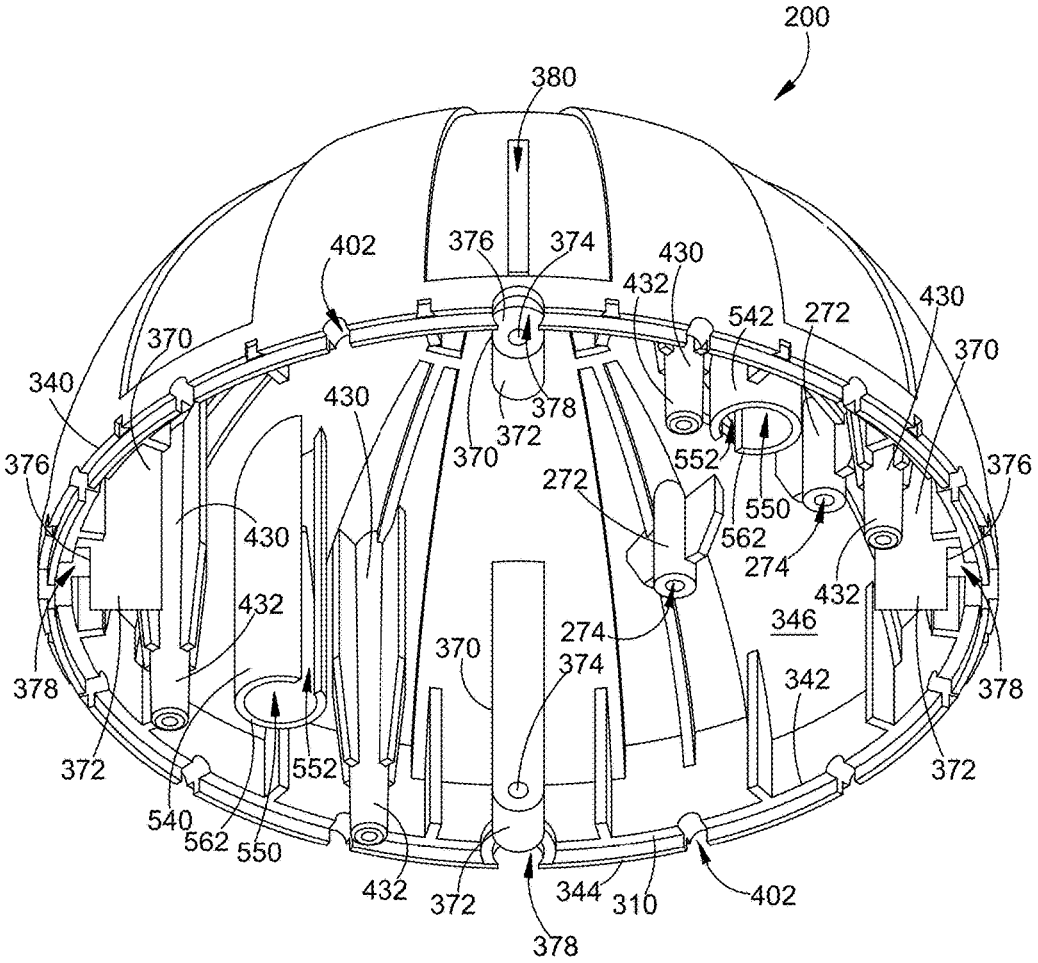
FIG. 11 illustrates a bottom perspective view of the inside of the upper inner shell of the fitness ball of FIG. 1 showing interconnection and mounting structures.

As shown in FIG. 8, the lower inner shell 120 has a lower mating surface 300. The lower mating surface defines a lower base plane of the lower inner shell. As shown in FIG. 11, the upper inner shell 200 has an upper mating surface 310. The upper mating surface defines an upper base plane of the upper inner shell. When the two hemispheres are engaged to form a sphere, the two mating surfaces meet at the equatorial plane 114 (FIGS. 1 and 2) of the sphere such that the equatorial plane and the two base planes are coincident or nearly coincident.

The lower mating surface 300 of the lower inner shell 120 includes a circular outer perimeter 320. In the illustrated embodiment, the outer perimeter has a radius of approximately 2.42 inches. The mating surface of the lower inner shell has a circular inner perimeter 322, which has a radius of approximately 2.29 inches. A circumferential groove 324 is formed in the mating surface approximately midway between the outer perimeter and the inner perimeter (e.g., approximately 0.043 inch radially inward from the outer perimeter). The groove has a depth into the mating surface of approximately 0.047 inch and has a radial width of approximately 0.047 inch. The lower inner shell has a generally hemispherical inner surface 326 that extends from the circular inner perimeter. Although generally hemispherical, the inner surface of the lower inner shell has varying inside diameters to maintain a generally constant shell thickness in view of differing elevations of the outer surface of the lower inner shell. The differing outer surface elevations are described below. A plurality of support structures (also described below) extend upward from the inner surface of the lower inner shell.

The upper mating surface 310 of the upper inner shell 200 has a circular outer perimeter 340 and a circular inner perimeter 342. The outer perimeter has a radius of approximately 2.42 inches; and the inner perimeter has a radius of approximately 2.32 inches. A circumferential ridge 344 extends from the mating surface at a position approximately 0.047 inch radially inward from the outer perimeter. The ridge has a height of approximately 0.047 inch and has a radial width of approximately 0.039 inch. The mating surface extends approximately 0.12 inch inward from the ridge to the inner perimeter. The upper inner shell has a hemispherical inner surface 346 that extends from the circular inner perimeter. Although generally hemispherical, the inner surface of the upper inner shell has varying inside diameters to maintain a generally constant shell thickness in view of differing elevations of the outer surface of the upper inner shell. The differing outer surface elevations are described below. A plurality of support structures (described below) extend downward from the inner surface of the upper inner shell.

When the upper hemisphere 112 is mated with the lower hemisphere 110, the circumferential ridge 344 of the mating surface 310 of the upper inner shell 200 engages with the circumferential groove 324 of the lower inner shell 120 to provide a snug friction fit between the upper inner shell and the lower inner shell.

The lower inner shell 120 includes a plurality of semicylindrical engagement supports 360 (e.g., 4 supports), which are evenly spaced around the outer perimeter 320 of the lower mating surface 300 (e.g., the supports are spaced approximately 90 degrees apart). Each engagement support has a respective through bore 362 (only two shown in the view of FIG. 8) that extends radially inward from an outer end of the support. An outer face 364 of each engagement support is recessed by a small distance (e.g., approximately 0.04 inch) from the outer perimeter of the mating surface of the lower inner shell to accommodate at least a portion of the thickness of the head of a self-tapping screw 366 (only two shown in the view of FIG. 8). The inner end of each engagement support extends by a short distance inward from the inner perimeter 322 of the mating surface to form an upper portion of a reinforcing rib 368. Each engagement support is positioned such that the center of the respective through bore of the engagement support is in the lower base plane of the lower mating surface (e.g., in the equatorial plane 114 at the juncture of the lower hemisphere 110 and the upper hemisphere 112). The through bores are sized to receive and provide clearance for the threads of the screws.

As shown in FIG. 11, the upper inner shell 200 includes a plurality of engagement ribs 370 (e.g. 4 ribs), which are evenly spaced (e.g., spaced 90 degrees apart) about the inner perimeter 342 of the upper mating surface 310 of the upper inner shell. An upper cylindrical portion 372 of each engagement rib includes a through bore 374 (only two shown in the view of FIG. 11) that has a diameter sized to receive and engage the threads of the screw 366 (FIG. 8). An outer surface 376 of each engagement rib is recessed inward from the inner perimeter 342 of the upper mating surface. A respective semicylindrical recess 378 is formed in the upper mating surface proximate to each rib. The recessed surface of the engagement rib and the semicylindrical recess provide clearance for a respective one of the engagement supports 360 of the lower inner shell 120 when the lower hemisphere 110 and the upper hemisphere 112 are engaged. In the illustrated embodiment, each engagement rib includes an externally disposed cavity 380. The cavity reduces the thickness of molded material in the engagement ribs to facilitate the injection molding process.

When the two hemispheres 110, 112 are engaged, each through bore 362 of the lower inner shell 120 is aligned with a respective one of the through bores 374 of the upper inner shell 200. A respective one of the screws 366 is positioned through each through bore of the lower inner shell and is engaged with the inner surface of the corresponding aligned through bore of the upper inner shell.

As further shown in FIG. 8, a plurality of semicylindrical ventilation openings 400 (e.g., twelve openings with only two openings labeled) are formed in the lower mating surface 300 of the lower inner shell 120. Three of the semicylindrical openings are positioned in each 90-degree segment of the lower mating surface between adjacent through bores 362. As shown in FIG. 11, a corresponding plurality of semicylindrical ventilation openings 402 (e.g., twelve openings with only two openings labeled) are formed in the upper mating surface 310 of the upper inner shell 200. Three of the semicylindrical openings are positioned in each 90-degree segment of the upper mating surface between adjacent through bores 374. The ventilation openings are positioned at substantially equal angles from adjacent openings or from an adjacent through bore. For example, in the illustrated embodiment, the semicylindrical openings are spaced apart by approximately 22.5 degrees. When the lower hemisphere 110 and the upper hemisphere 112 are engaged to form the complete sphere, the semicylindrical ventilation openings from the two hemispheres are aligned to create cylindrical ventilation openings into the interior of the completed sphere at the equatorial plane 114. The ventilation openings enable the release of heat from the interior of the sphere produced by the motor 150 and the electronics.

As further shown in FIG. 8, the lower inner shell 120 includes four cylindrical lower alignment posts 420 spaced in a rectangular pattern around the inner surface 326 of the lower inner shell. Each lower alignment post extends from the inner surface toward the lower base plane defined by the lower mating surface 300 of the lower inner shell. The lower alignment posts are perpendicular to the lower base plane. Each lower alignment post is hollow to form a hexagonal inner surface 422. At the respective upper (exposed) end of each alignment post, the inner surface of each alignment post has an inside diameter of approximately 5 millimeters between opposing flat faces. The inner surface of each alignment post tapers to a smaller inside diameter at a respective lower end where the alignment post intersects the inner surface of the lower inner shell.

As shown in FIG. 11, the upper inner shell 200 includes four cylindrical upper alignment posts 430 spaced in a rectangular pattern around the inner surface 346 of the upper inner shell. Each upper alignment post extends from the inner surface toward the upper base plane defined by the upper mating surface 310 of the upper inner shell. The upper alignment posts are perpendicular to the upper base plane and extend approximately 6 millimeters beyond the upper base plane. Each upper alignment post has a cylindrical outer surface 432, which has an outside diameter slightly smaller than the inside diameter of the inner surfaces 422 of the lower alignment posts 420. Each upper alignment post tapers outward to a larger diameter near where the post intersects the inner surface of the upper inner shell. When the lower hemisphere 110 and the upper hemisphere 112 are engaged, the extended portion of each upper alignment post slides into a corresponding hollow lower alignment post such that the respective outer surface of each upper alignment post engages a respective inner surface of a lower alignment post. The engagements of the alignment posts further assure that the two hemispheres are properly aligned.

Figure 10:
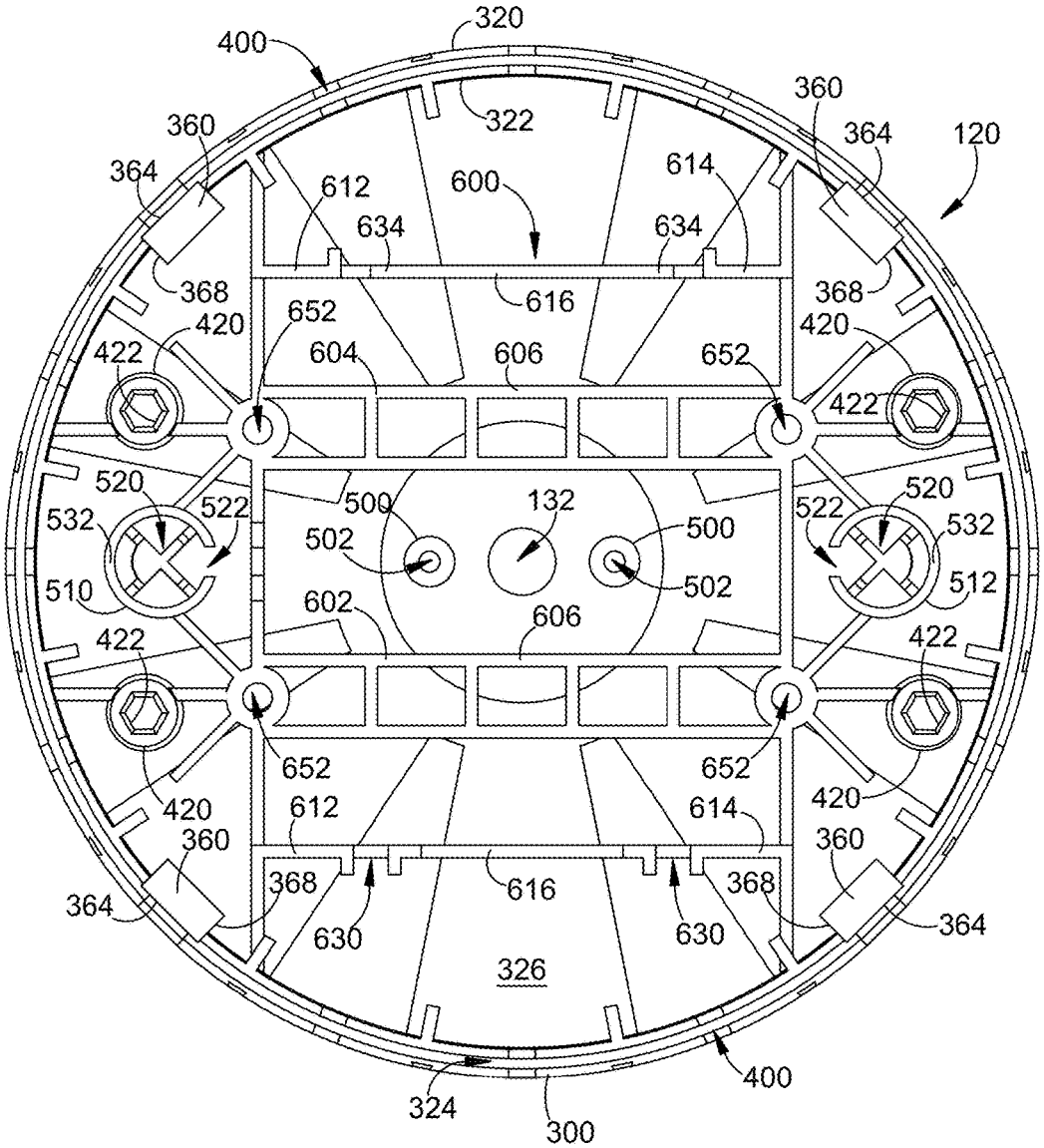
FIG. 10 illustrates a top plan view of the lower inner shell of FIGS. 8 and 9.

As further shown in FIG. 10, the lower inner shell 120 of the lower hemisphere includes two power adapter supports 500 positioned proximate to the bore 132. Each support includes a respective circular bore 502 that receives a screw (not shown) to secure the power adapter jack assembly 130 (FIG. 4) to the lower inner shell with the engagement face of the adapter jack approximately flush with the outer surface of the lower inner shell.

Figure 5:
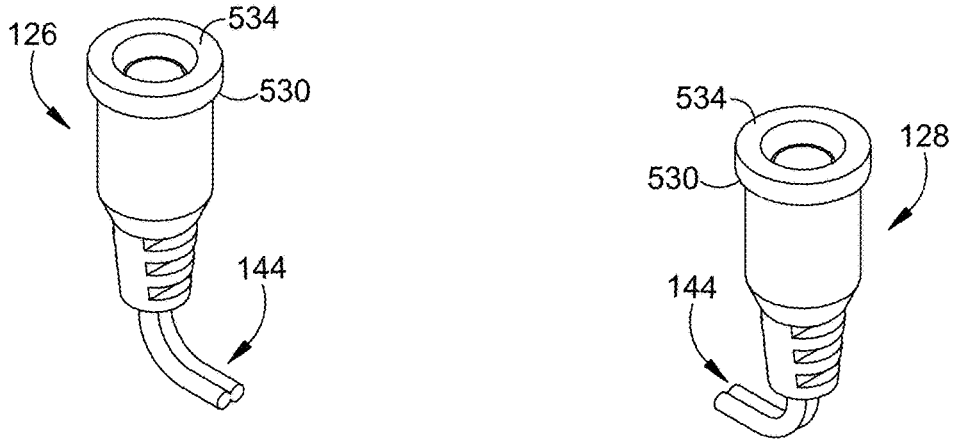
FIG. 5 illustrates enlarged perspective views of the first and second barrel jacks of FIG. 4.
Figure 7:
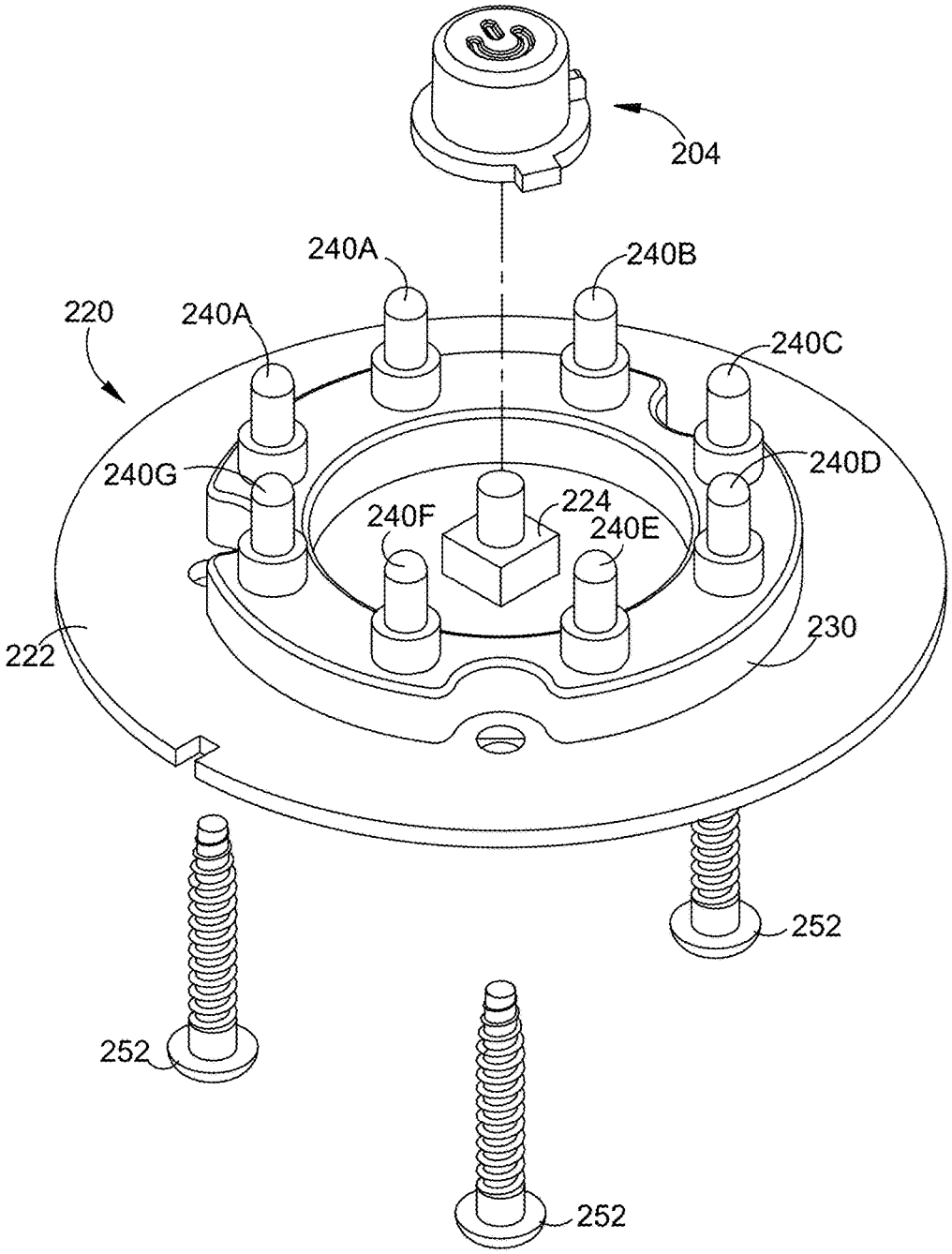
FIG. 7 illustrates an enlarged perspective view of the circuit board assembly and the switch activator of FIG. 4.

The lower inner shell 120 further includes a first jack support 510 and a second jack support 512, which extend from the inner surface 326 of the lower inner shell and extend toward the lower base plane defined by the lower mating surface 300. Each jack support includes a generally cylindrical inner bore 520 that is sized to receive the cylindrical body of a respective one of the first barrel jack 140 and the second barrel jack 142 (FIGS. 4 and 5). Each jack support includes a vertical slot 522 that provides clearance to allow the integral wiring pigtail 144 of the respective barrel jack to exit from the inner bore. As shown in FIG. 5, each barrel jack has a shoulder 530 that rests on an upper end 532 of the cylindrical jack support. The height of the cylindrical jack support is selected in combination with the thickness of the shoulder of the barrel jack such that an exposed outer surface 534 of the shoulder is approximately coplanar with the lower mating surface 300 of the lower inner shell when the barrel of the jack is fully inserted into the bore of the cylindrical plug support.

Figure 6:
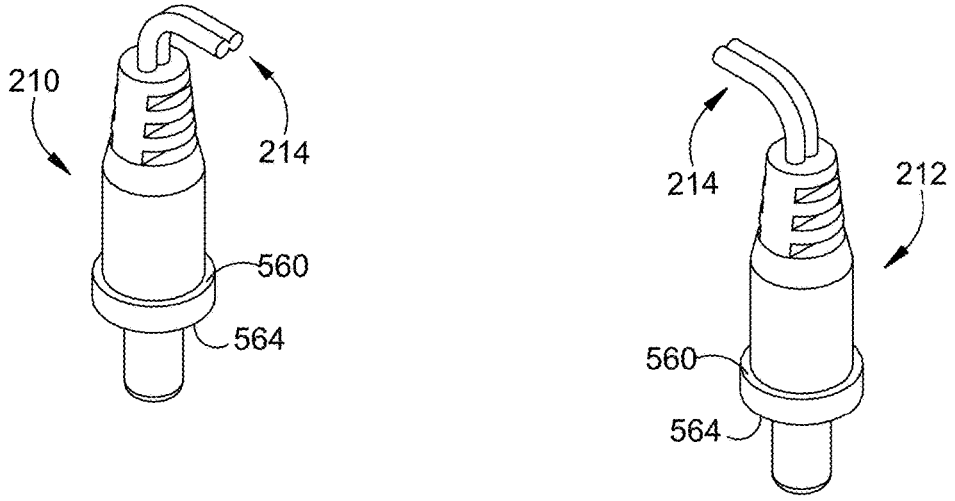
FIG. 6 illustrates enlarged perspective views of the first and second barrel plugs of FIG. 4.

As shown in FIG. 11, the upper inner shell 200 further includes a first plug support 540 and a second plug support 542, which extend from the inner surface 346 of the upper inner shell and extend toward the upper base plane defined by the upper mating surface 310. Each plug support includes a generally cylindrical inner bore 550 that is sized to receive the cylindrical body of a respective one of the first barrel plug 210 and the second barrel plug 212 (FIGS. 4 and 6). Each plug support includes a vertical slot 552 that provides clearance to allow the integral wiring pigtail of the respective barrel plug to exit from the inner bore. As shown in FIG. 6, each barrel plug has a shoulder 560 that rests on a lower end 562 of the cylindrical plug support. The height of the cylindrical plug support is selected in combination with the thickness of the shoulder of the barrel plug such that an exposed outer surface 564 of the shoulder is approximately coplanar with the upper mating surface of the upper inner shell when the barrel of the plug is fully inserted into the bore of the cylindrical plug support. The plug supports in the upper inner shell and the jack supports in the lower inner shell are positioned in the respective shells such that when the two hemispheres 110, 112 are aligned by engaging the upper alignment posts 430 with the lower alignment posts 420, the barrel plugs of the upper hemisphere engage the barrel jacks 140, 142 of the lower hemisphere to electrically connect the two hemispheres.

Figure 14:
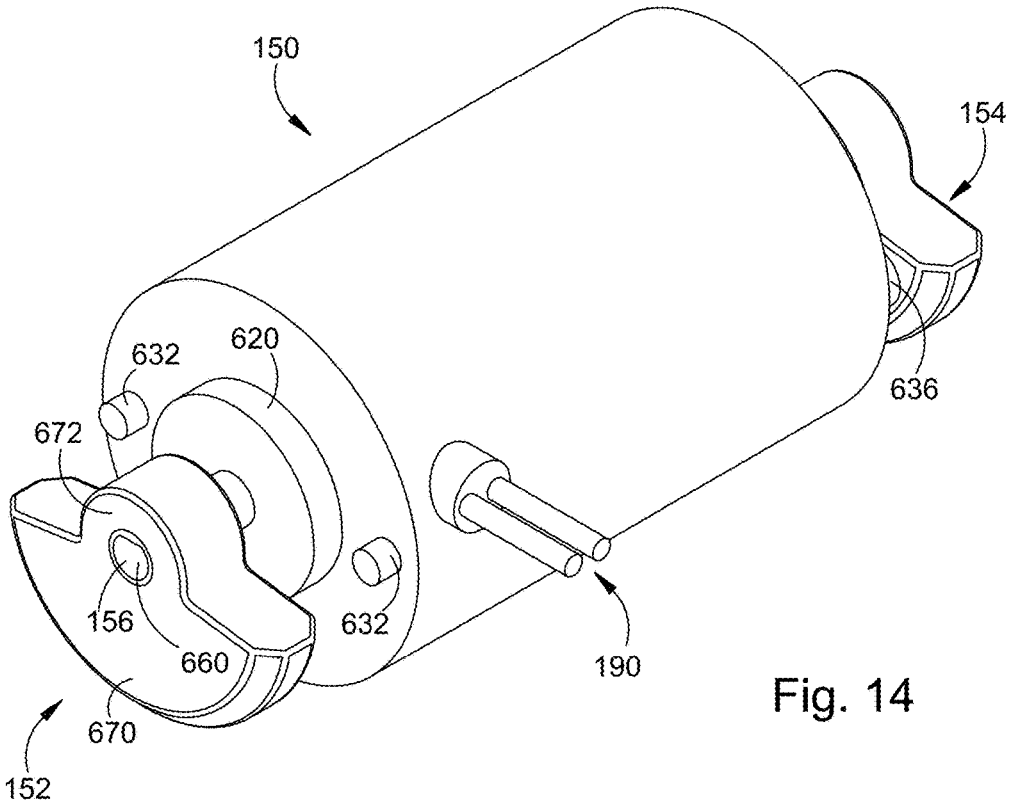
FIG. 14 illustrates a perspective view of the motor and the eccentric masses at each end of the motor shaft viewed from a first end of the motor.
Figure 15:
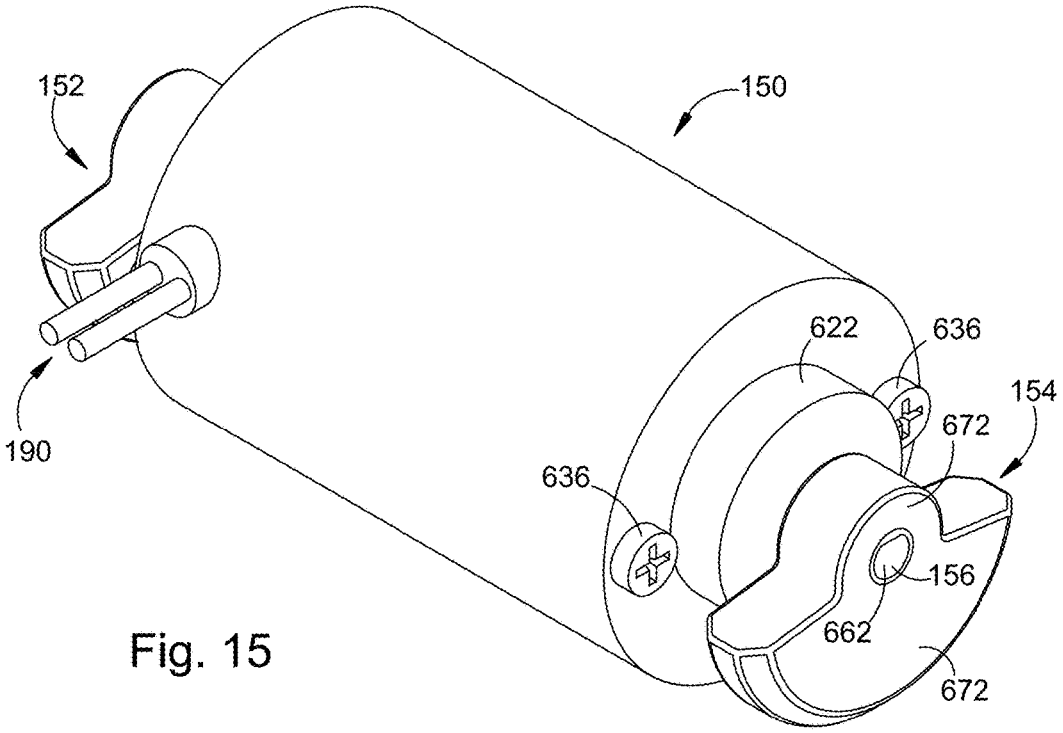
FIG. 15 illustrates a perspective view of the motor and the eccentric masses rotated from the view in FIG. 14 to show the second end of the motor.

The electric motor 150 is shown in more detail in FIGS. 14 and 15. In the illustrated embodiment, the motor comprises a Model No. YXN2924D009 DC electric motor commercially available from Shenzen Shunding Motor Co., Ltd., of Shenzhen, China. The motor has a cylindrical outer diameter of approximately 23 millimeters and has an overall shaft length of approximately 105 millimeters.

The motor 150 rests in a motor support frame 600 shown in FIGS. 8 and 10. The motor support frame extends from the inner surface 326 of the lower inner shell 120. The support frame includes a first inner rib 602 and a second inner rib 604. In the illustrated embodiment, each inner rib is a composite rib with two spaced-apart rib walls interconnected with cross-ribs to provide the strength of a thicker rib but within thinner components to facilitate the injection molding process. Each inner rib has an arcuate upper surface 606 that conforms substantially to the outer circumference of the motor. A respective one of the first and second lower arcuate bushings 160, 162 is positioned on the arcuate upper surface of each inner rib between the outer circumference of the motor and the upper surface.

The support frame 600 further includes a first end rib 610 and a second end rib 612. Each end rib has a respective upper surface 614 having a respective arcuate portion 616. The arcuate portion of the first end rib conforms to the outer circumference of a first motor bearing 620 (FIG. 14) proximate to a first end of the motor 150. The arcuate portion of the second end rib conforms to the outer circumference of a second motor bearing 622 (FIG. 15) proximate to a second end of the motor. The upper surface of the first end rib includes two semi-hemispherical notches 630. Each notch receives a respective protrusion 632 on the first end of the motor. The engagements of the protrusions with the notches inhibit rotation of the motor body with respect to the support frame. The upper surface of the second end rib includes a pair of horizontal portions 634 that provide clearance for the heads of a pair of screws 636 on the second end of the motor enclosure as shown in FIG. 15. The screws are part of the structure of the motor.

Figure 20:
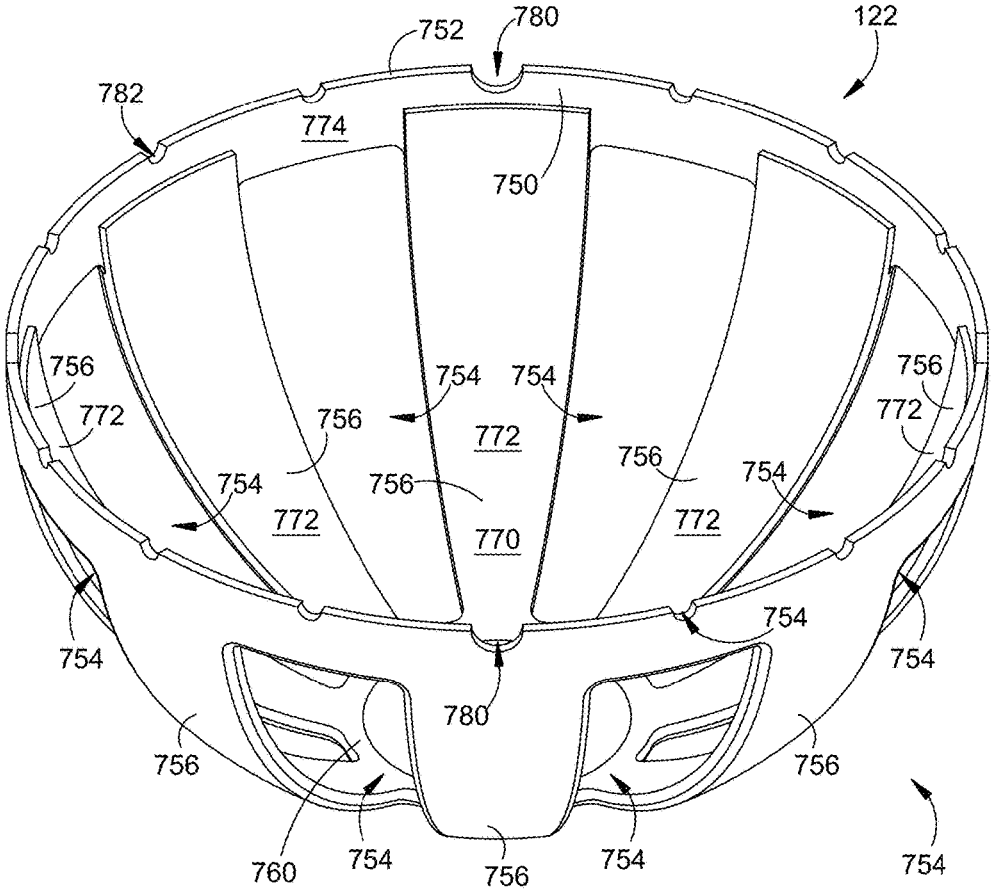
FIG. 20 illustrates an upper perspective view of the lower outer cover prior to installation onto the lower inner cover.

The motor 150 is secured to the support frame 600 via the first and second arcuate mounting straps 170, 172 and the four screws 174 (FIG. 4). Each screw engages a respective inner bore 650 in the support frame proximate to each end of the first inner rib 602 and the second inner rib 604. As discussed above, a respective one of the first and second upper arcuate bushings 180, 182 is positioned between the outer circumference of the motor and each mounting strap. When the motor is secured to the support frame as shown in FIG. 20, the lower arcuate bushings 160, 162 and the upper arcuate bushings 180, 182 are compressed against the outer circumference of the motor to secure the motor firmly between the support frame and the mounting straps. Accordingly, the vibrations of the motor (described below) are communicated directly to the lower inner shell 120 without allowing relative movement between the motor and the lower inner shell. The secure interconnection between the lower inner shell and the upper inner shell 200, as described above, assure that the vibrations of the motor are communicated to both the lower hemisphere 110 and the upper hemisphere 112 of the vibrating ball 100.

As discussed above, the motor 150 includes a shaft 156. The shaft has a first end portion 660 that extends through the first motor bearing 620 and has a second end portion 662 that extends through the second motor bearing 622. In the illustrated embodiment, the shaft has a radius of approximately 5.8 millimeters. The first eccentric mass 152 is secured to the first end portion of the shaft. The second eccentric mass 154 is secured to the second end portion of the shaft.

In the illustrated embodiment, each eccentric mass 152, 154 is formed as an arcuate portion of a cylindrical shape. For example, in the illustrated embodiment, the cylindrical shape has a radius of approximately 21 millimeters and has a thickness of approximately 11 millimeters. Each mass is formed by a 150-degree segment 670 of the cylindrical shape. Each mass includes a central collar 672 having an outer radius of approximately 7.5 millimeters and having an inner radius of approximately 5.8 millimeters to provide a tight fit to motor shaft 156. Each mass is press fitted onto the respective end portion of the motor shaft and is secured to the shaft by spot welding the mass to the shaft or by using a set screw (not shown) in the collar of the mass. In the illustrated embodiment, each eccentric mass comprises stainless steel and has a weight (mass) of approximately 36-40 grams. As illustrated, the two masses are preferably aligned with respect to each other so that the eccentric forces caused by the rotation of the masses are in the same radial direction with respect to the shaft.

Figure 16:
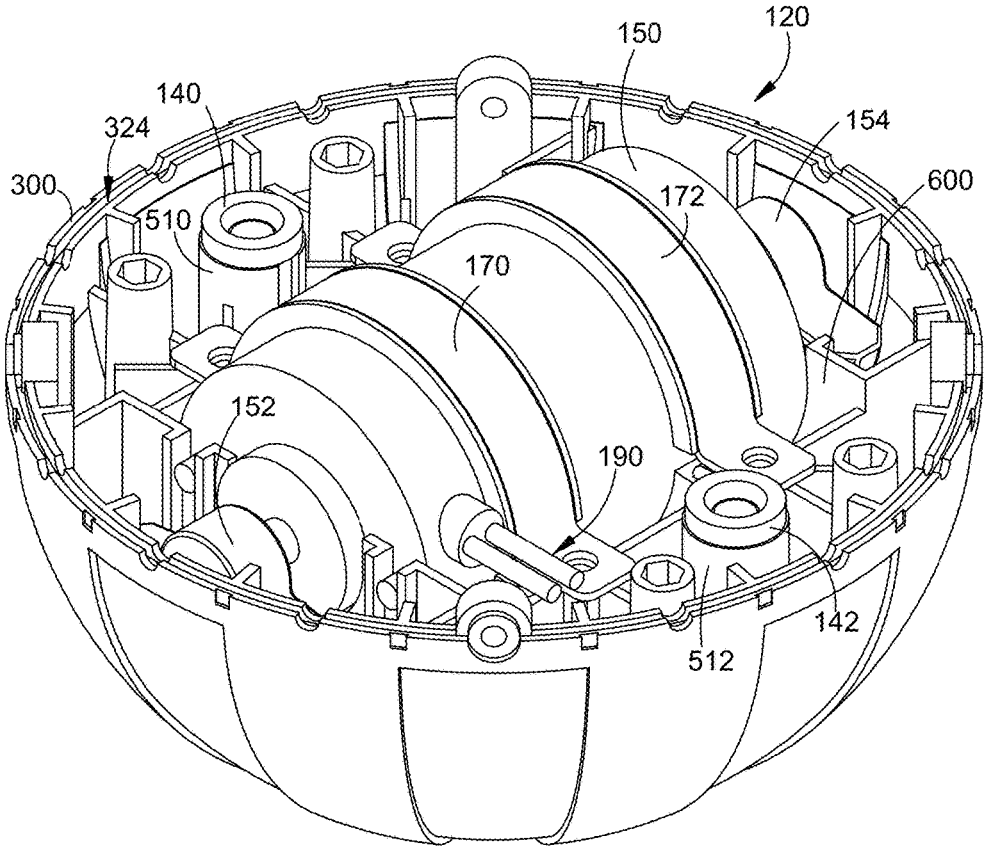
FIG. 16 illustrates a top perspective view of the lower inner shell with the motor installed on the support structure and with the barrel jacks positioned in the jack supports.

As discussed above, the power wires 190 of the motor 150 are electrically connected to the integral wiring pigtail of the second barrel jack 142 FIG. 16). When the two hemispheres 110, 112 are interconnected, the second barrel plug 212 connects the second barrel jack to the circuit board assembly 220 to provide power to the motor. As described below with respect to the circuit diagram in FIG. 28, the components on the printed circuit board 222 of the circuit board assembly control the operation of the motor in response to the operation of the pushbutton switch 224. The pushbutton switch is selectively closed in response to manual manipulation of the switch actuator 204 to activate and deactivate the circuits. Further closings of the switch when the circuits are active, select an operational mode (e.g., a vibration frequency) for the fitness ball 100. In the illustrated embodiment, the fitness ball has three operational modes and selectively produces a vibration frequency corresponding to each operational mode. The electronic circuits on the printed circuit board control the indications provided by the LEDs 240A-H, as described below. The LED indications include an on-off indication, battery status and a selected operational mode. The LEDs also indicate when the fitness ball is connected to a power adapter and the battery is being charged.

Figure 17:
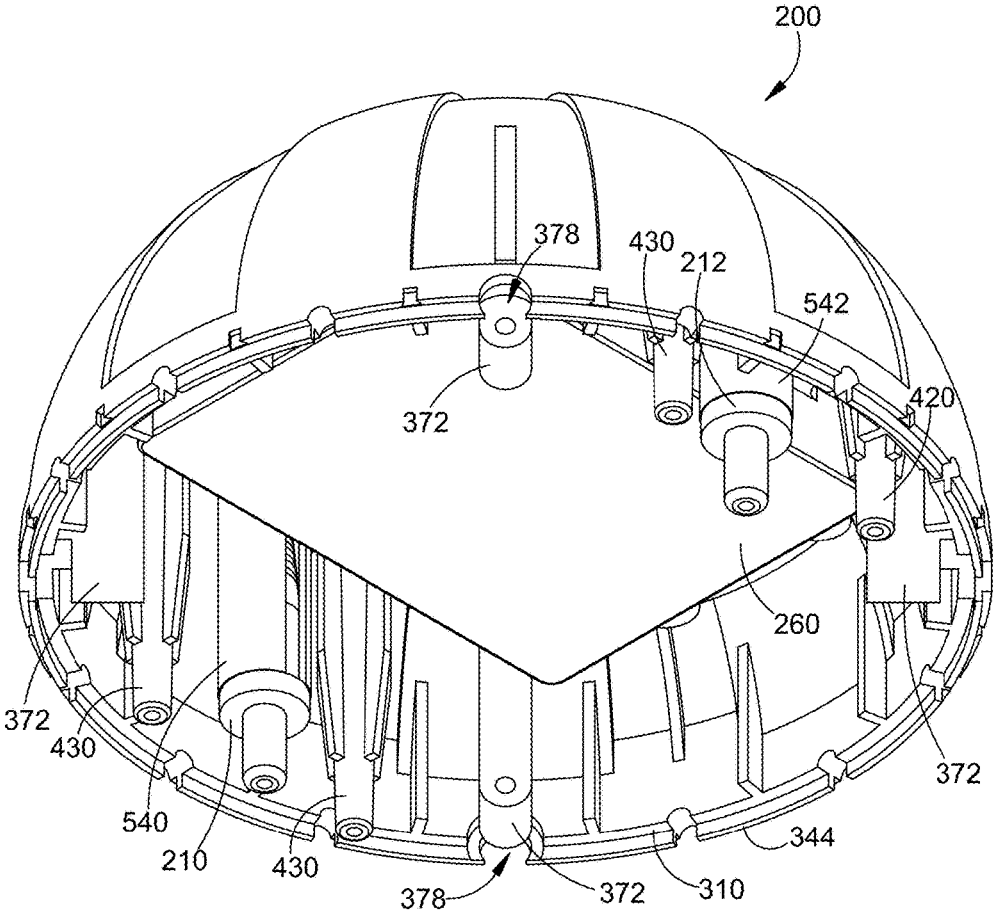
FIG. 17 illustrates a bottom perspective view of the upper inner shell with the components installed therein, wherein the printed circuit board, the indicator LEDs and the switch actuator are hidden by the battery assembly.

As shown in FIG. 16, the motor 150 is positioned near the center of the spherical fitness ball 100. The mounting screws 174 (FIG. 4) are not shown in FIG. 16. The motor is offset a short distance into the lower inner shell 120 to at least partially compensate for the mass of the battery assembly 260 in the upper inner shell 200 (FIG. 17). Although the motor and the eccentric masses are heavier than the battery assembly and the circuit board assembly 220, the moment arm of the center of gravity of the motor with respect to the equatorial plane 114 is shorter than the moment arm of the center of gravity of the components in the upper inner shell with respect to the equatorial plane. Thus, the overall center of gravity of the spherical ball is close to the equatorial plane so that the spherical ball is substantially balanced along an axis (not shown) between the lower pole 116 and the upper pole 118. As shown in FIGS. 16 and 17, the components are substantially centered within the respective hemispheres along the other two orthogonal axes. Thus, the perceptible balance of the spherical ball is similar irrespective of the orientation of the ball when the ball is grasped by a user.

Figure 18:
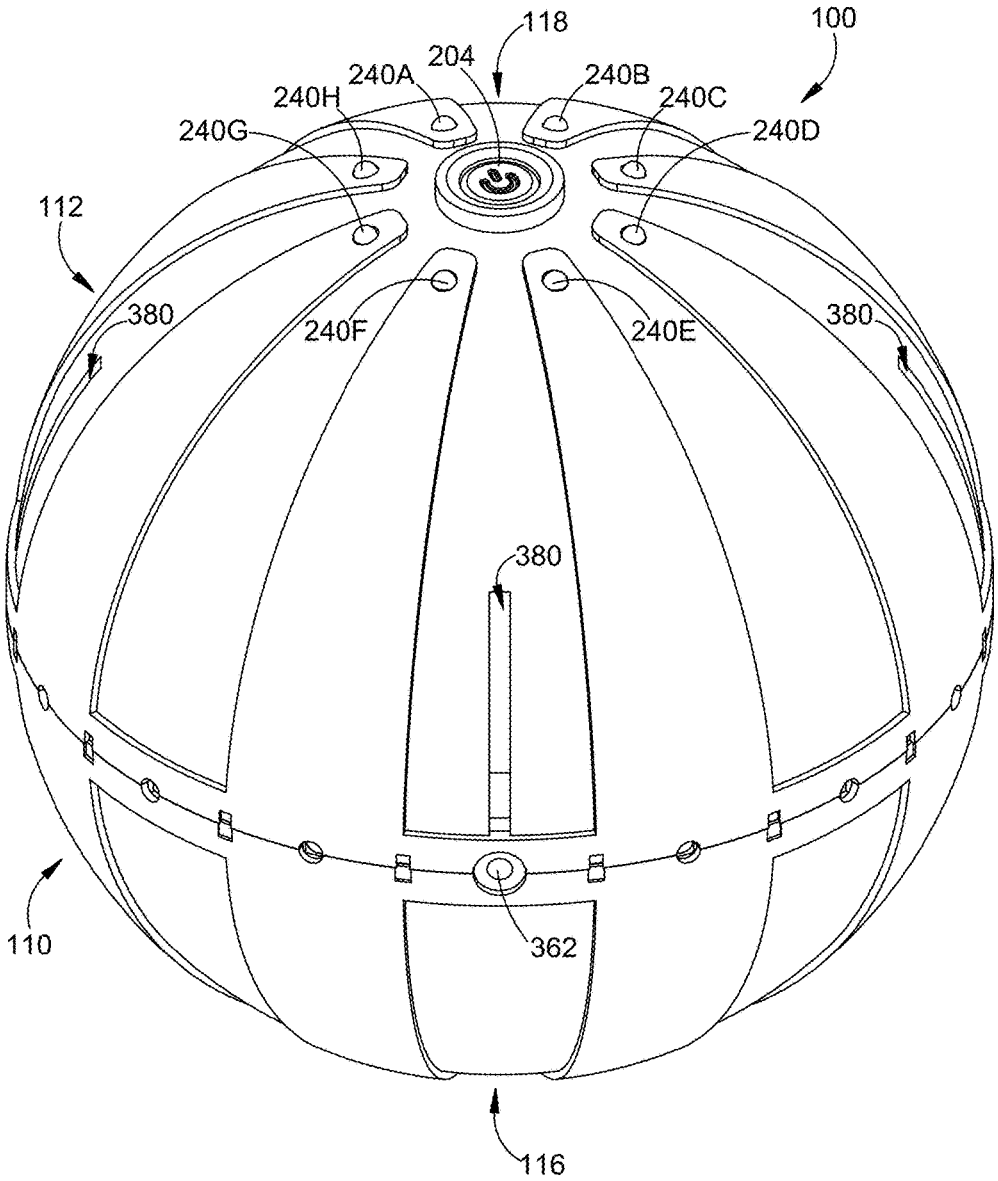
FIG. 18 illustrates the upper inner shell and the lower inner shell assembled together to form the completed fitness ball prior to installation of the upper and lower outer covers.

The two eccentric masses 152, 154 rotate about an axis (e.g., the motor shaft 156) that is close to the equatorial plane 114. The rotation of the eccentric masses causes the motor to vibrate. The vibrations are coupled to the lower shell via the motor support frame 600. When the upper outer shell and the lower outer shell are interconnected as shown in FIG. 18, the secure interconnection of the lower inner shell and the upper inner shell couple the vibrations to the upper inner shell. Thus, vibrations are induced in the entire ball structure. Because of the generally centered masses and the location of the vibrational axis, the fitness ball 100 provides a similar vibrational effect in all orientations.

In addition to providing supports for the motor 150, for the battery assembly 260 and for the other internal components, the internal structures for the two inner shells 120, 200 include additional reinforcing ribs that enable the two shells, when interconnected, to support substantial weight (e.g., up to approximately 300 pounds).

Figure 19:
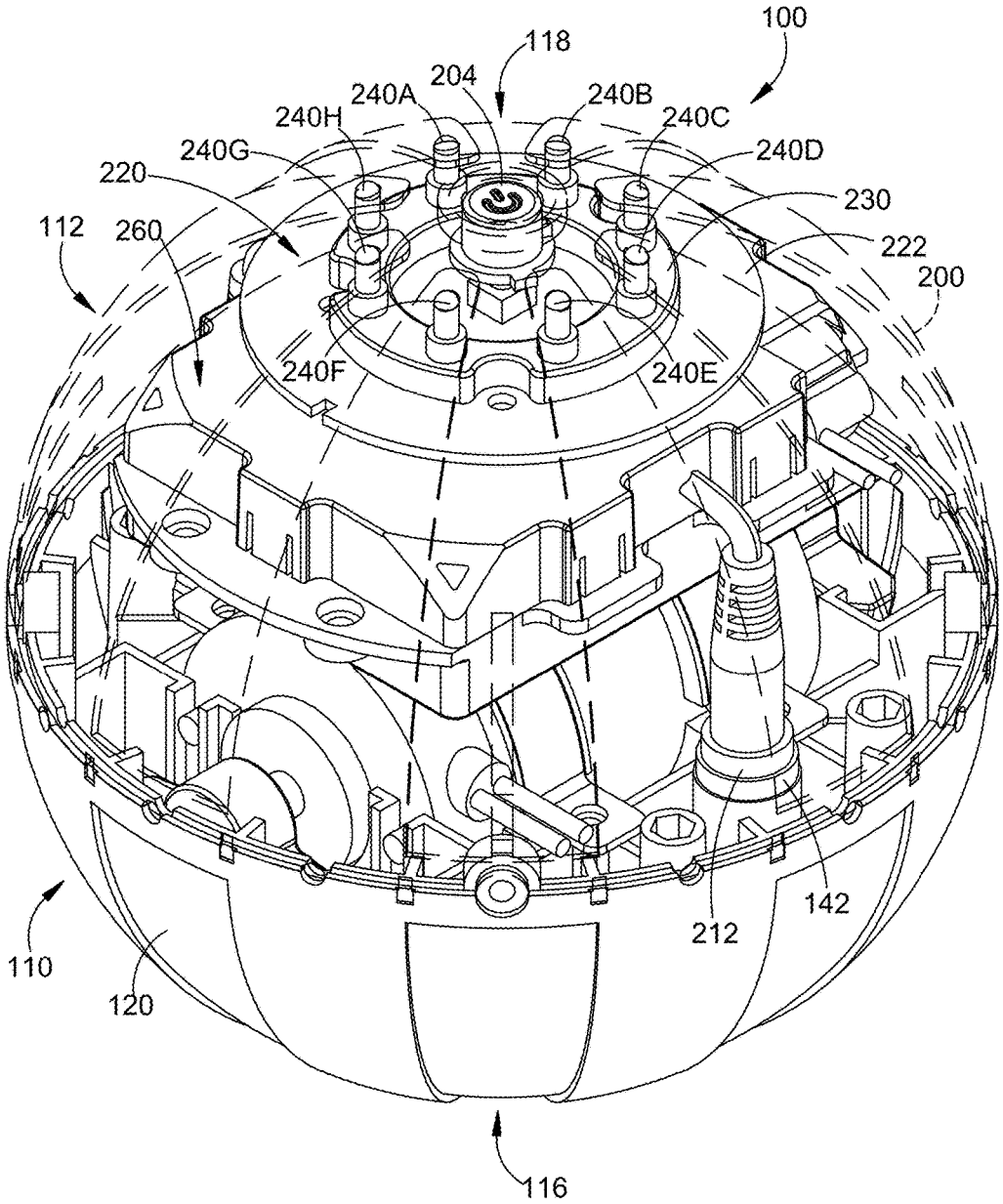
FIG. 19 illustrates the assembled upper and lower inner shells of FIG. 18 with the upper inner shell shown as transparent to show the battery assembly, the circuit board assembly, the indicator LEDs and the switch actuator.

FIG. 19 illustrates the assembled lower inner shell 120 and upper inner shell 200 of FIG. 18 with the upper inner shell represented in dashed lines to represent transparency and to thereby show the positional relationships of the battery assembly 260, the circuit board assembly 220 (including the printed circuit board 222 and the LED support ring 230), and the switch actuator 204 within the upper inner shell.

Figure 9:
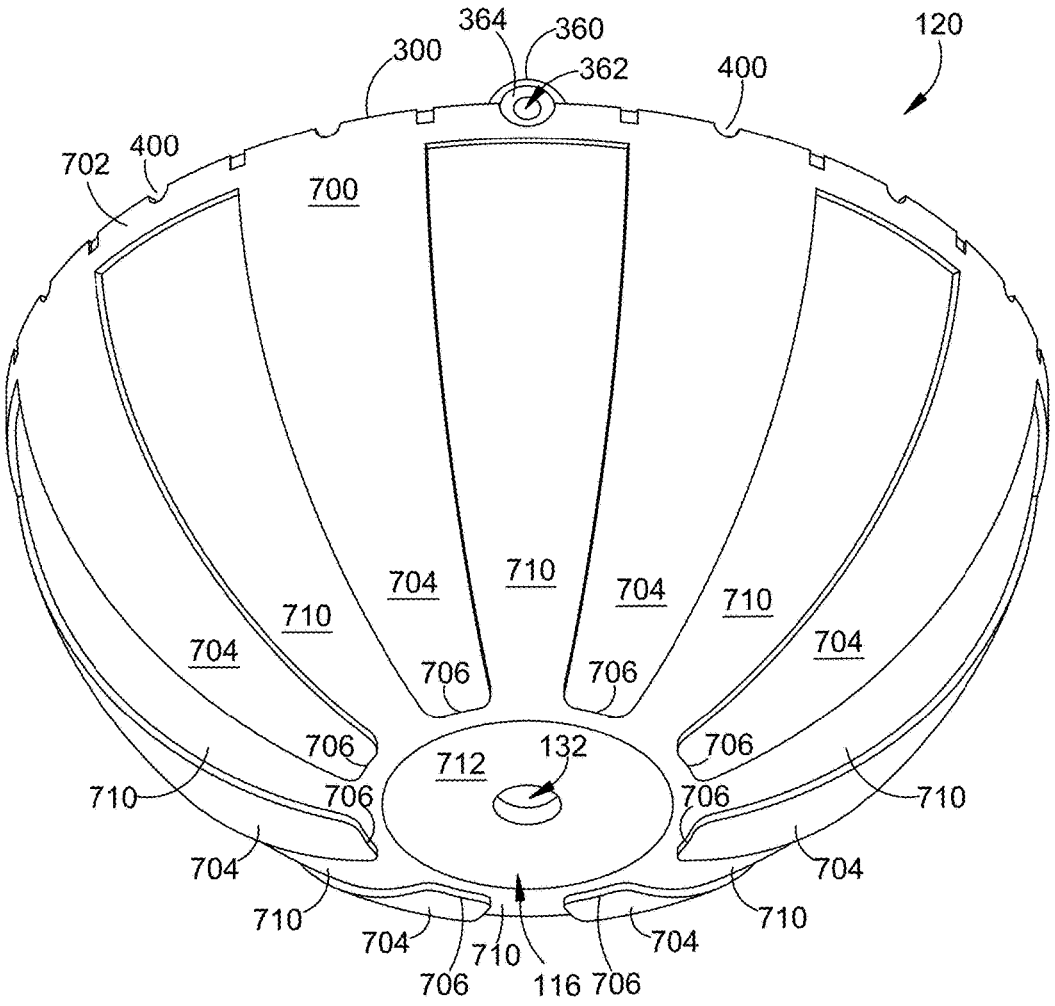
FIG. 9 illustrates a bottom perspective view of the outer surface of the lower inner shell of FIG. 8.

As shown in FIG. 9, an outer surface 700 of the lower inner shell 120 has an equatorial ring 702 of raised material proximate to the lower base plane corresponding to the lower mating surface 300. A plurality of tapered raised surface segments 704 extend from the equatorial ring toward the lower pole 116. The tapered raised surface segments terminate a selected distance away from the lower pole at respective ends 706. The tapered raised surface segments are spaced apart angularly by interleaved unraised surface segments 710. In the illustrated embodiment, the outer surface has eight raised surface segments and eight unraised surface segments having angular widths of approximately 22.5 degrees each. The unraised surface segments meet at a flattened portion 712 of the outer surface surrounding the lower pole. The opening 132 for the power adapter jack assembly 130 (FIG. 4) is positioned substantially in the middle of the flattened surface portion. As briefly discussed above, the inner surface 326 of the lower inner shell has varying diameters such that the thickness of the lower inner shell between the outer surface and the inner surface is substantially the same beneath the raised and unraised surface segments.

As shown in FIGS. 9 and 10, an outer surface 720 of the upper inner shell 200 has an equatorial ring 722 of raised material proximate to the upper base plane defined by the upper mating surface 310 of the upper inner shell. A plurality of tapered raised surface segments 724 extend from the equatorial ring toward the upper pole 118. The tapered raised surface segments terminate at respective upper ends 726 a selected distance away from the upper pole. The through bores 250 for the LEDs extend through the tapered raised surface segments near the respective upper ends. The tapered raised surface segments are spaced apart angularly by interleaved unraised surface segments 730. A portion 732 of the outer surface surrounding the upper pole is also unraised. A raised annular ring 734 is positioned around the central bore 206 at the upper pole. In the illustrated embodiment, the raised annular ring has an outer diameter of approximately 16 millimeters and an inner diameter of approximately 10.1 millimeters. In the illustrated embodiment, the outer surface has eight raised surface segments and eight unraised surface segments having angular widths of approximately 22.5 degrees each. As briefly discussed above, the inner surface 346 of the upper inner shell has varying diameters such that the thickness of the upper inner shell between the outer surface and the inner surface is substantially the same beneath the raised and unraised surface segments.

Figure 21:
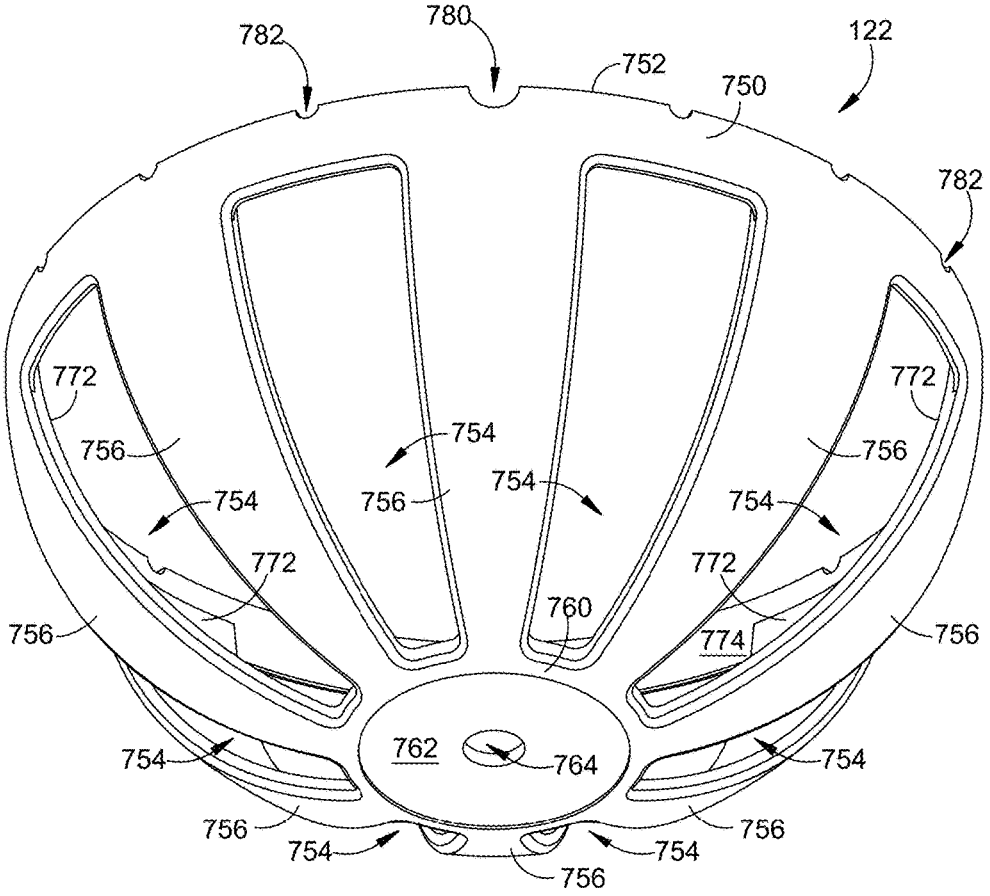
FIG. 21 illustrates a lower perspective view of the lower outer cover of FIG. 20.

As shown in FIGS. 20 and 21, the lower outer cover 122 in the illustrated embodiment is generally hemispherical. The elastomer material of the lower outer cover extends around the base of the hemisphere to form an equatorial band 750 of material proximate to a base surface 752. The base surface is generally coplanar with the lower mating surface 300 of the lower inner shell 120 when the lower outer cover is attached to the lower inner shell. The lower outer cover has a plurality of tapered open areas 754, where the elastomer material is removed, thus forming tapered segments 756 of unremoved material interleaved with the open areas. In the illustrated embodiment, eight open areas and eight tapered segments are formed around the hemisphere. The amount of material removed and the amount of material remaining are similar in area such that each open area and each segment have respective angular widths around the sphere of approximately 22.5 degrees. The segments of unremoved material are interconnected at respective ends displaced from the equatorial band of material to form a lower polar ring 760 of material around a lower polar recessed surface 762 on the outside surface of the cover. In the illustrated embodiment, the lower polar recess has a diameter of approximately 35 millimeters. The lower polar recess is sized to receive a circular informational label (not shown). The lower polar recess surrounds a lower polar opening 764, which has a diameter of approximately 8 millimeters.

The lower outer cover 122 has a spherical inner surface 770 (FIG. 20) that includes inner surfaces 772 of each of the plurality of tapered segments 756 of unremoved material.

The inner surfaces of the tapered segments have a spherical curvature selected to be substantially the same as the curvature of the outer surface 700 of the lower inner shell 120 so that the lower outer cover fits snugly over the lower inner shell. The inner surfaces of the eight tapered segments of the lower outer cover do not extend to the base surface 752 of the cover. Thus, an inner surface 774 of the equatorial band 750 is recessed (outwardly displaced when viewed from the inside of the lower outer cover) with respect to the inner surfaces of the tapered segments. The inner surfaces of the tapered segments of the lower outer cover are sized such that when the lower outer cover is positioned over the lower inner shell 120, the inner surfaces of the tapered segments of the lower outer cover fit snugly into the unraised surface segments 710 (FIG. 9) of the outer surface 700 of the lower inner shell. The raised surface segments 704 of the lower inner shell extend partially into the open areas 754 of the lower outer cover. Thus, the lower outer cover and the lower inner shell are interlocked such that the lower outer cover cannot rotate with respect to the lower inner shell. The lower outer cover is secured to the lower inner shell by a suitable adhesive material.

Figure 22:
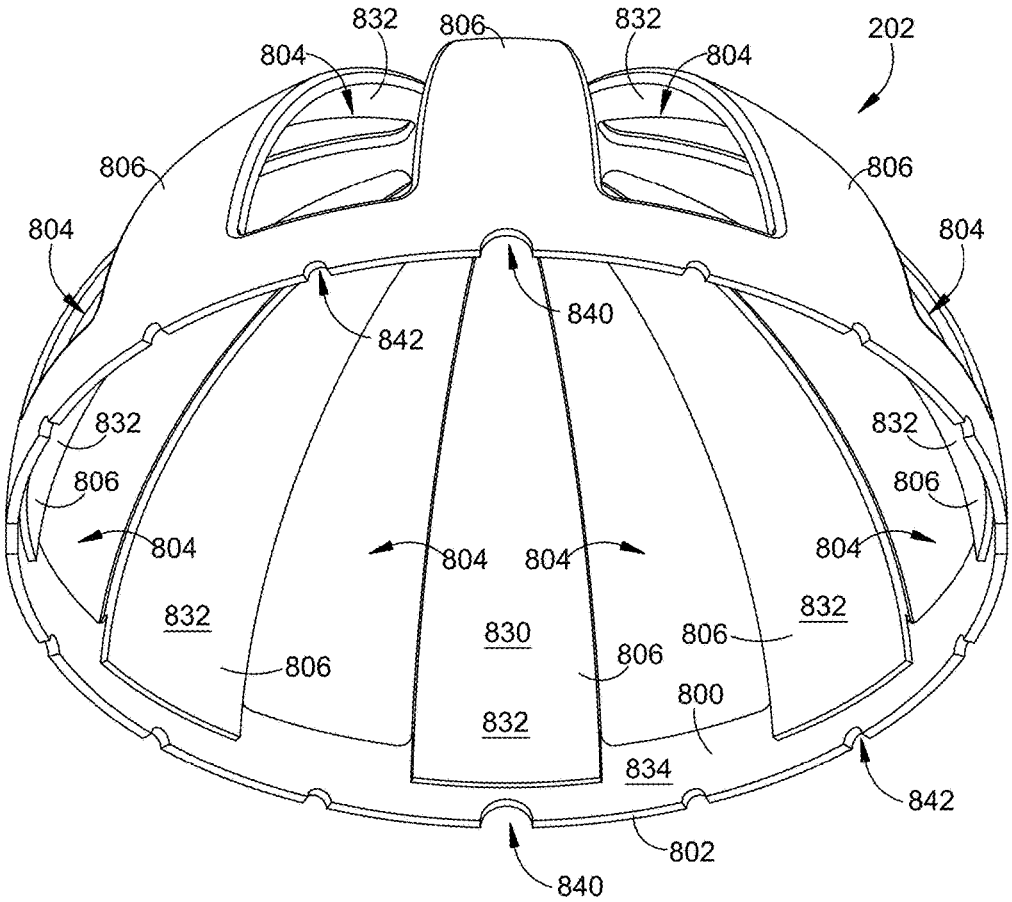
FIG. 22 illustrates a lower perspective view of the upper outer cover prior to installation onto the upper inner cover.
Figure 23:
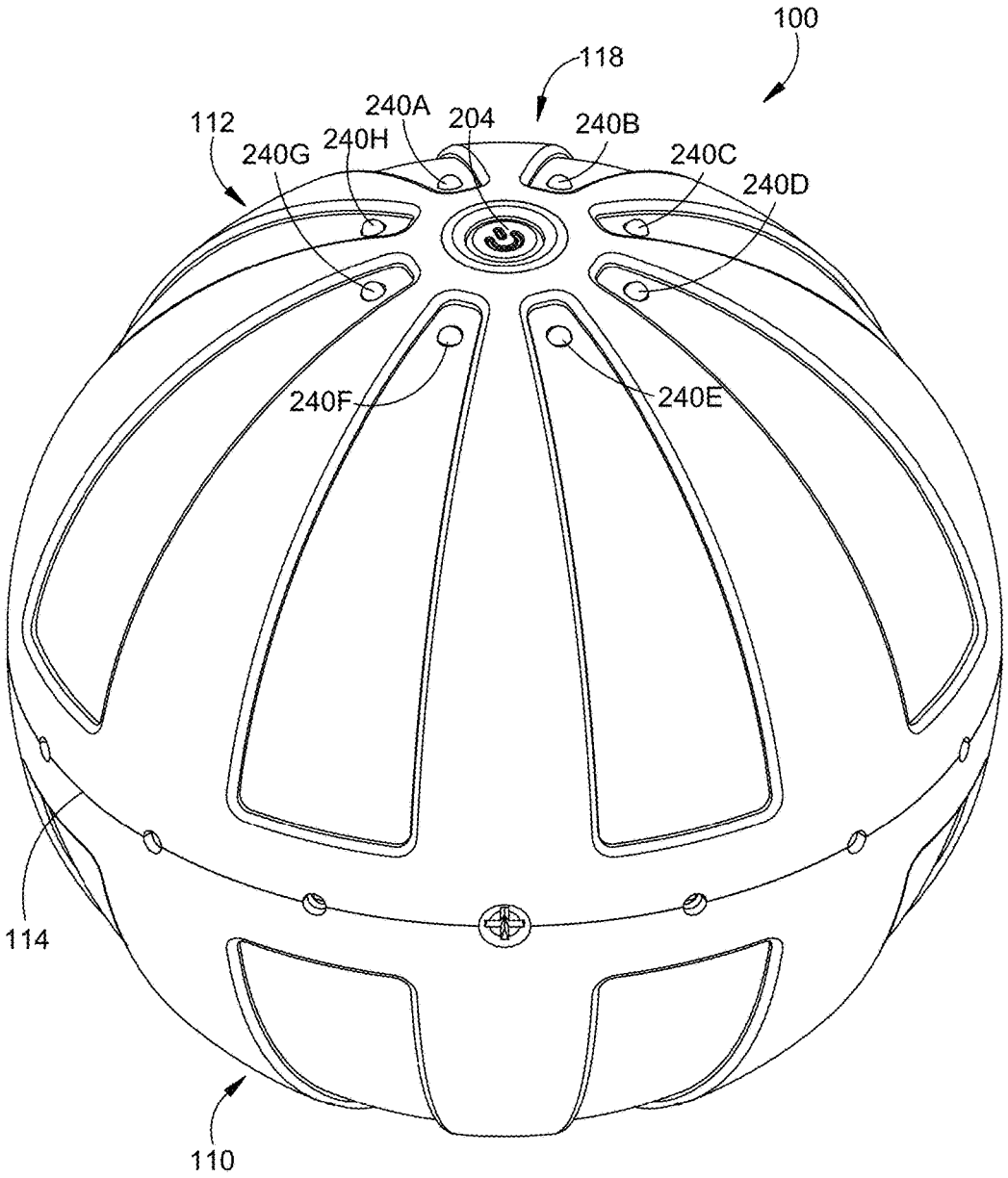
FIG. 23 illustrates an upper perspective view of the upper outer cover of FIG. 20.

The lower outer cover 122 includes a first plurality of semicircular notches (e.g., four notches) 780 of a first diameter and a second plurality of semicircular notches (e.g., twelve notches) 782 of a second diameter formed into the base surface 752. When the lower outer cover is attached to the lower inner shell 120, the first plurality of notches align with the though bores 362 to provide clearance for the screws 366. The second plurality of notches align with the ventilation openings 400 of the lower inner shell, As shown in FIGS. 22 and 23, the upper outer cover 202 in the illustrated embodiment is generally hemispherical with the elastomer material extending around the base of the hemisphere to form an equatorial band 800 of material proximate to a base surface 802. The base surface is generally coplanar with the upper mating surface 310 of the upper inner shell 200 when the upper outer cover is attached to the upper inner shell. The upper outer cover has a plurality of tapered open areas 804, where the elastomer material is removed, thus forming tapered segments 806 of unremoved material interleaved with the open areas. In the illustrated embodiment, eight open areas and eight tapered segments are formed around the hemisphere. The amount of material removed and the amount of material remaining are similar in area such that each open area and each segment have respective angular widths around the sphere of approximately 22.5 degrees. The segments of unremoved material are interconnected at respective ends displaced from the equatorial band of material to form an upper polar ring 810 of material around an upper polar bore 812. In the illustrated embodiment, the upper polar bore has a diameter of approximately 16 millimeters. The upper polar bore is sized to correspond to the outer diameter of the raised annular ring 734 of the upper inner shell 200.

Figure 12:
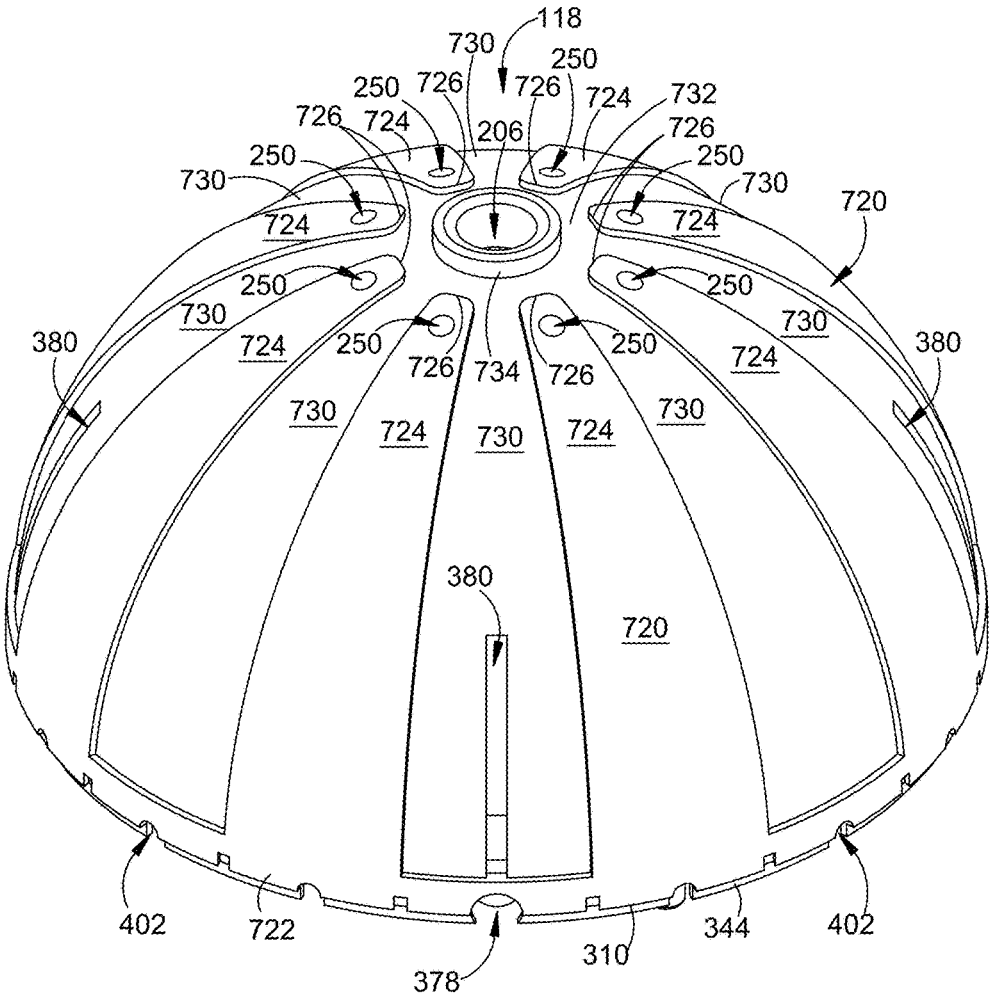
FIG. 12 illustrates a top perspective view of the outer surface of the upper inner shell of FIG. 11.

The upper outer cover 202 has a spherical inner surface 830 that includes inner surfaces 832 of each of the plurality of tapered segments 806 of unremoved material. The inner surfaces of the tapered segments have a spherical curvature selected to be substantially the same as the curvature of the outer surface 720 (FIG. 12) of the upper inner shell 200 so that the upper outer cover fits snugly over the upper inner shell. The inner surfaces of the eight tapered segments of the upper outer cover do not extend to the base surface 802. Thus, an inner surface 834 of the equatorial band 800 is recessed (outwardly displaced when viewed from the inside of the upper outer cover) with respect to the inner surfaces of the tapered segments. The inner surfaces of the tapered segments of the upper outer cover are sized such that when the upper outer cover is positioned over the upper inner shell, the inner surfaces of the tapered segments of the upper outer cover fit snugly into the unraised surface segments 730 (FIG. 12) of the outer surface of the upper inner shell. The tapered raised surface segments 724 of the upper inner shell extend partially into the open areas 804 of the upper outer cover. The upper outer cover is interlocked with the upper inner shell such that the upper outer cover cannot rotate with respect to the upper inner shell. The upper outer cover is secured to the upper inner shell by a suitable adhesive material. When the upper outer cover is positioned on the upper inner shell, the through bores 250 in the upper ends of the raised surface segments of the upper inner shell are exposed through the open areas of the upper outer cover.

The upper outer cover 202 includes a first plurality of semicircular notches (e.g., four notches) 840 of a first diameter and a second plurality of semicircular notches (e.g., twelve notches) 842 of a second diameter formed into the base surface 802. When the upper outer cover is attached to the upper inner shell 200, the first plurality of notches align with the though bores 374 (FIG. 11) to provide clearance for the screws 366 (FIG. 8). The second plurality of notches align with the ventilation openings 402 (FIG. 8) of the upper inner shell.

Because of the interlocking of the covers and the inner shells, the adhesive material does not have to withstand shear forces when the fitness ball 100 is twisted. The textured surfaces of the unremoved material of the outer covers provide a gripping surface. The edges of the removed (open) portions of the two covers provide additional gripping features. Together, the textured gripping surface and the edges of the material cause the fitness ball to be easy to hold when the ball is vibrating.

In the illustrated embodiment, the lower outer cover 122 and the upper outer cover 202 incorporate a commercially available thermoplastic elastomer (TPE) that provides a textured soft grip polymer skin so that the fitness ball is easily gripped by a user. As briefly mentioned above, the outer covers are colored and designed to provide a pleasing aesthetic appearance. For example, the tapered open areas 754, 804 of the outer covers expose the underlying outer surfaces of the inner shells 120, 200. The dark (e.g., black) color of the outer surfaces of the shells contrasts with the bright color of the outer covers.

As briefly discussed above, the pushbutton switch 224 on the printed circuit board 222 is closed a selected number of times to turn the power on and to cause the motor 150 to rotate at one of three rotational speeds that correspond to three vibrational frequencies. In one embodiment, the three vibrational frequencies are selected to be approximately 45 Hz, 68 Hz and 92 Hz, corresponding to rotation of the motor at approximately 2,700 RPM, 4,080 RPM and 5,520 RPM, respectively, when the battery cells in the battery cell pack 262 are fully charged. The rotational speeds are produced by adjusting a pulse-modulated voltage applied to the motor. In one test, the vibrating fitness ball produced vibrations having amplitudes of approximately 7.0 g at 45 Hz, approximately 14.1 g at 68 Hz and approximately 25.5 g at 92 Hz. The test further showed that the vibrational amplitudes are similar when measured along a polar axis between the upper pole 118 and the lower pole 116 and when measured along an axis orthogonal to the polar axis, thus suggesting that the rigid inner shell of the vibrating fitness ball distributes the vibrations approximately uniformly over the outer surface of the ball. The rotation speeds and the resulting vibrational frequencies may vary with the charge level of the battery cells in the battery cell pack. In further embodiments, other vibrational frequencies may be selected. Furthermore, other embodiments may allow selection of more than three vibrational frequencies.

Figure 24:
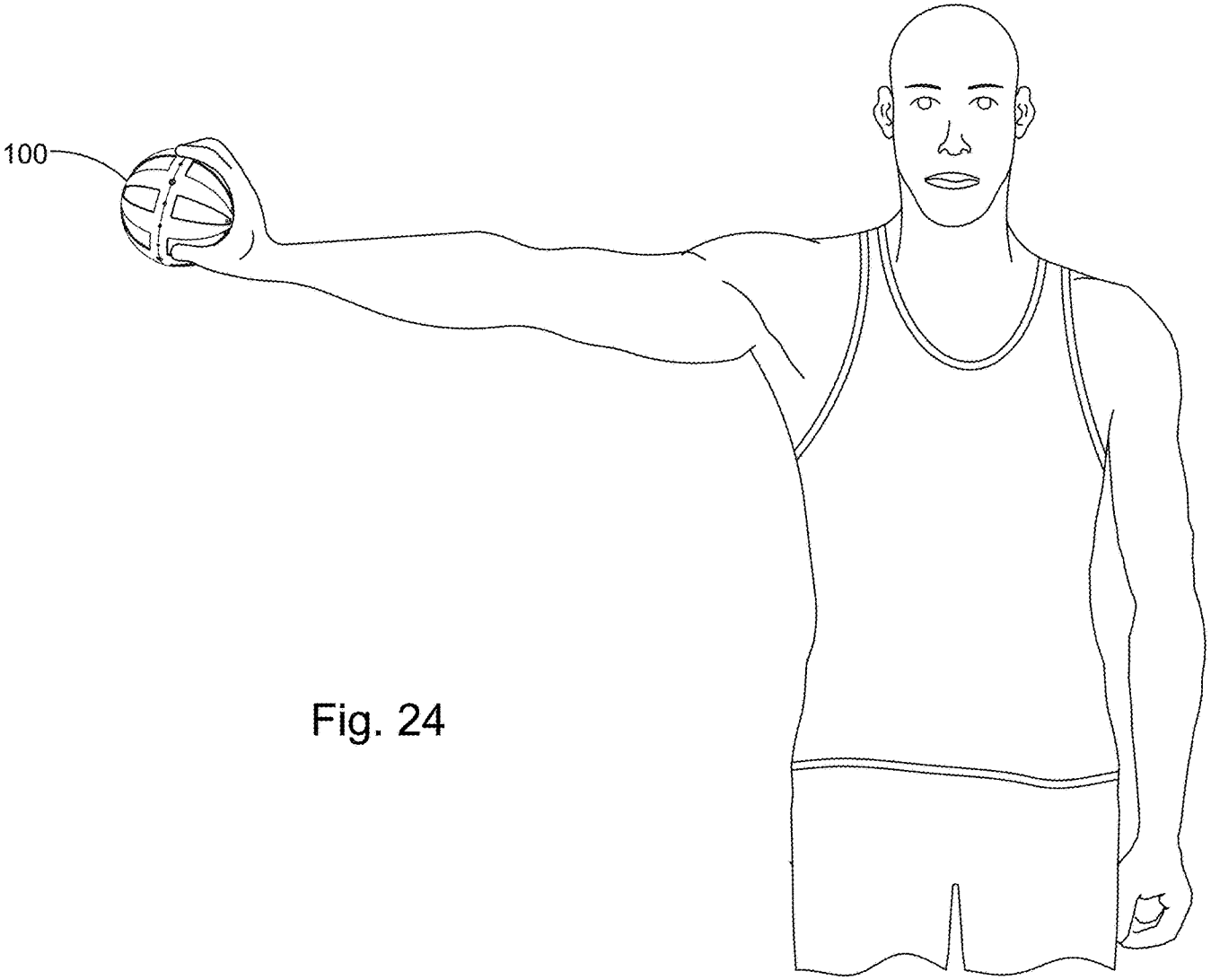
FIG. 24 illustrates the vibrating fitness ball gripped by a user to communicate vibration to the users hands, arms and shoulders to create peripheral perturbation to the upper extremities of the users body.

When the vibrating fitness ball 100 is held by a user, as shown in FIG. 24, for example, the vibration on the external surfaces are communicated to the user's hands, arms and shoulders via the outer covers 122, 202. The vibration creates a peripheral perturbation to the upper extremities of the user's body. The perturbations cause an increased neural drive to the muscle spindles of the stabilizers of the glenohumeral joint of the user's shoulder and the scapulothoracic joint. The increased neural drive caused by the vibration enhances joint stability and overall neuromuscular control, which potentially reduces injuries, optimizes performance and speeds recovery processes.

Figure 25:
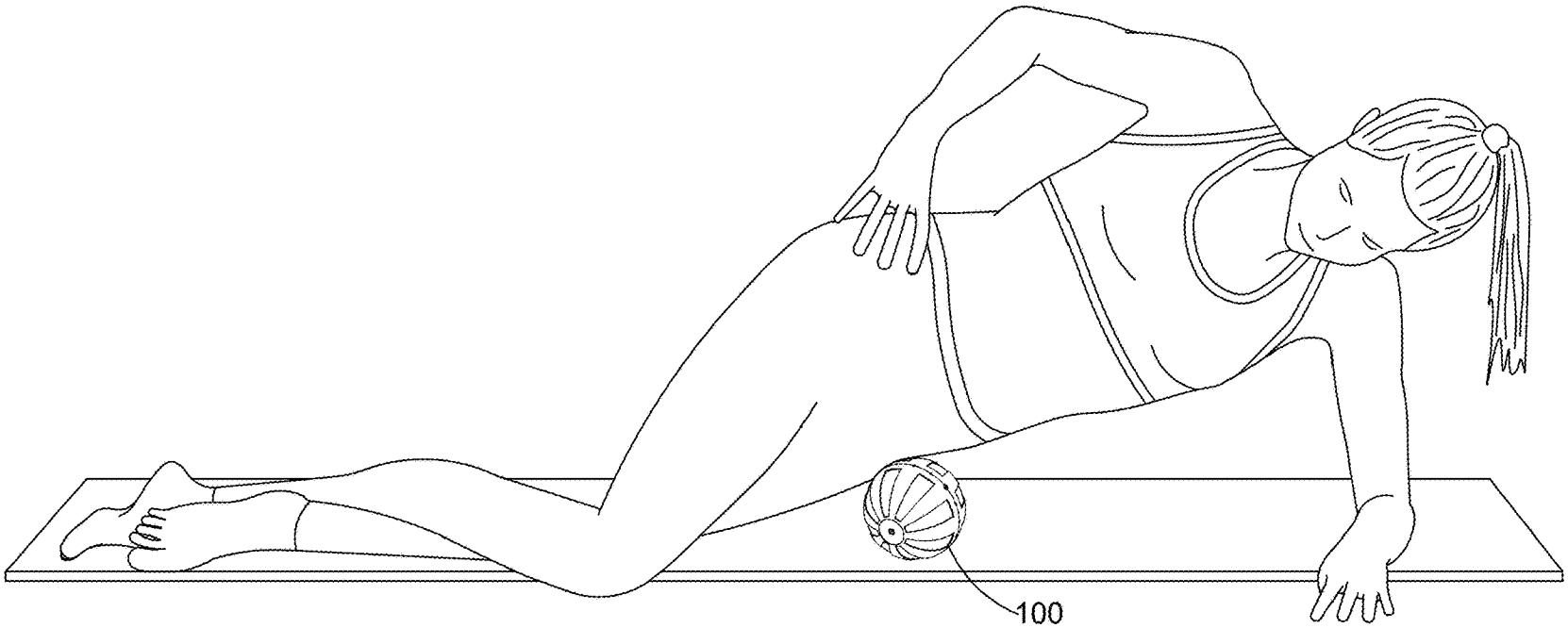
FIG. 25 illustrates the vibrating fitness ball positioned between a first portion of a users body and a floor mat to apply vibrating pressure to the first portion of the user's body.
Figure 26:
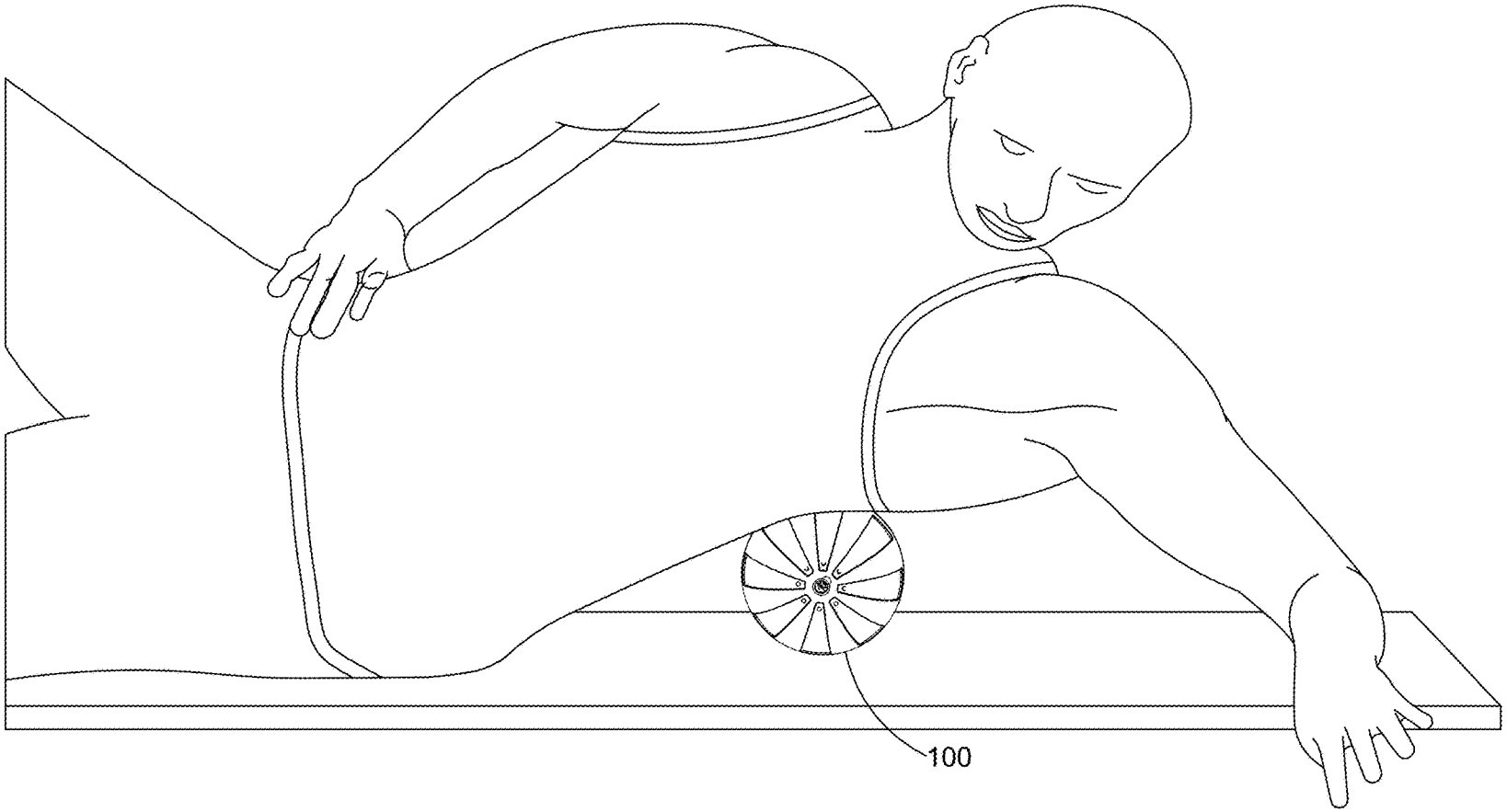
FIG. 26 illustrates the vibrating fitness ball positioned between a second portion of a user's body and a floor mat to apply vibrating pressure to the second portion of the user's body.
Figure 27:
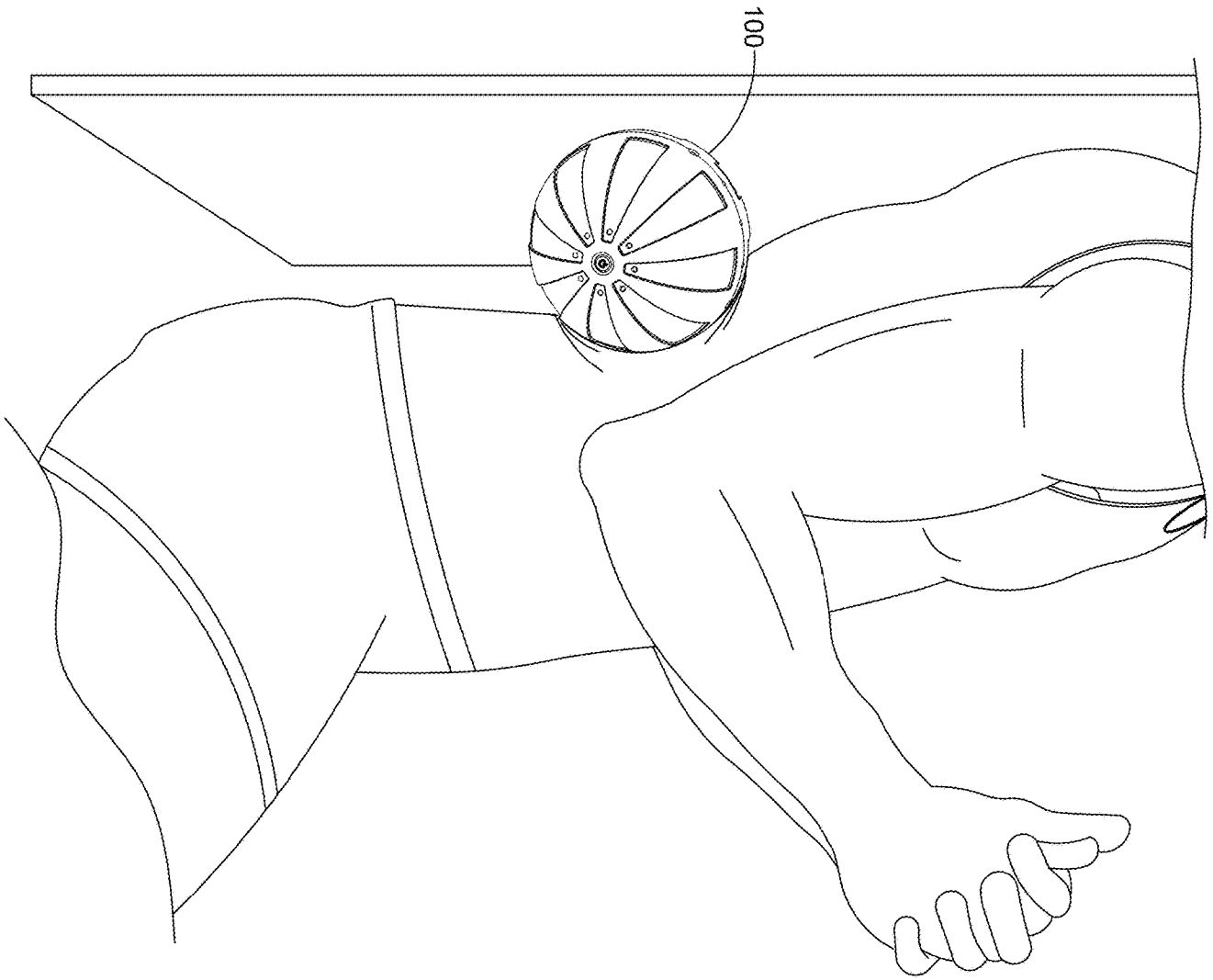
FIG. 27 illustrates the vibrating fitness ball positioned between a user's back and a wall to apply vibrating pressure to various locations on the user's back as the user moves vertically with respect to the wall.

The vibrating fitness ball 100 can also be used for other massaging functions such as applying vibrating massage to various muscles of the user's body. The size and the shape of the fitness ball allows the ball to be easily gripped in one hand and applied to a selected portion of the user's body or to the body of another person. For example, the rotationally symmetric hemispherical shape allows the user to grip the fitness ball without respect to orientation. The relatively small outside diameter (e.g., approximately 5 inches) of the fitness ball allows the ball to be positioned, for example, at the base of the user's neck to massage the superior portions of the trapezius muscles. Because of the ABS structure, the fitness ball has sufficient structural strength that it can be withstand up to 300 pounds of force. Thus, for example, a user may position the ball on a floor or a mat, as shown in FIGS. 25 and 26, for example, and lie on the ball to massage the middle and lower portions of the trapezius muscles and to massage the muscles of the lower back. The ball may also be positioned between a user's back and a wall, as shown in FIG. 27, for example. The user raise and lower his or her body with respect to the ball to movably position the ball at various locations on the back from the neck to the lower back. Using the vibrating fitness ball as illustrated in FIGS. 25, 26 and 27 has advantages over conventional cylindrical foam rollers, which are commonly used for myofascial release and for loosening muscles and soft tissue. Because of the cylindrical shape, a roller has a relatively large contact area against a user's body and is not able to apply pressure and vibration to a well-defined area of the body. Softballs, tennis balls and lacrosse balls have been used to pin-point targeted areas and penetrate deeper into the tissues in areas such as piriformis, tensor fasciae latae (TFL), trapezius, glutes and hamstrings. The vibrating fitness ball provides additional benefits by decreasing the pain felt by a user because the vibration distracts the pain receptors and nerves, thereby allowing the user to apply pressure deeper into the soft tissue for a more effective treatment.

Figure 28:
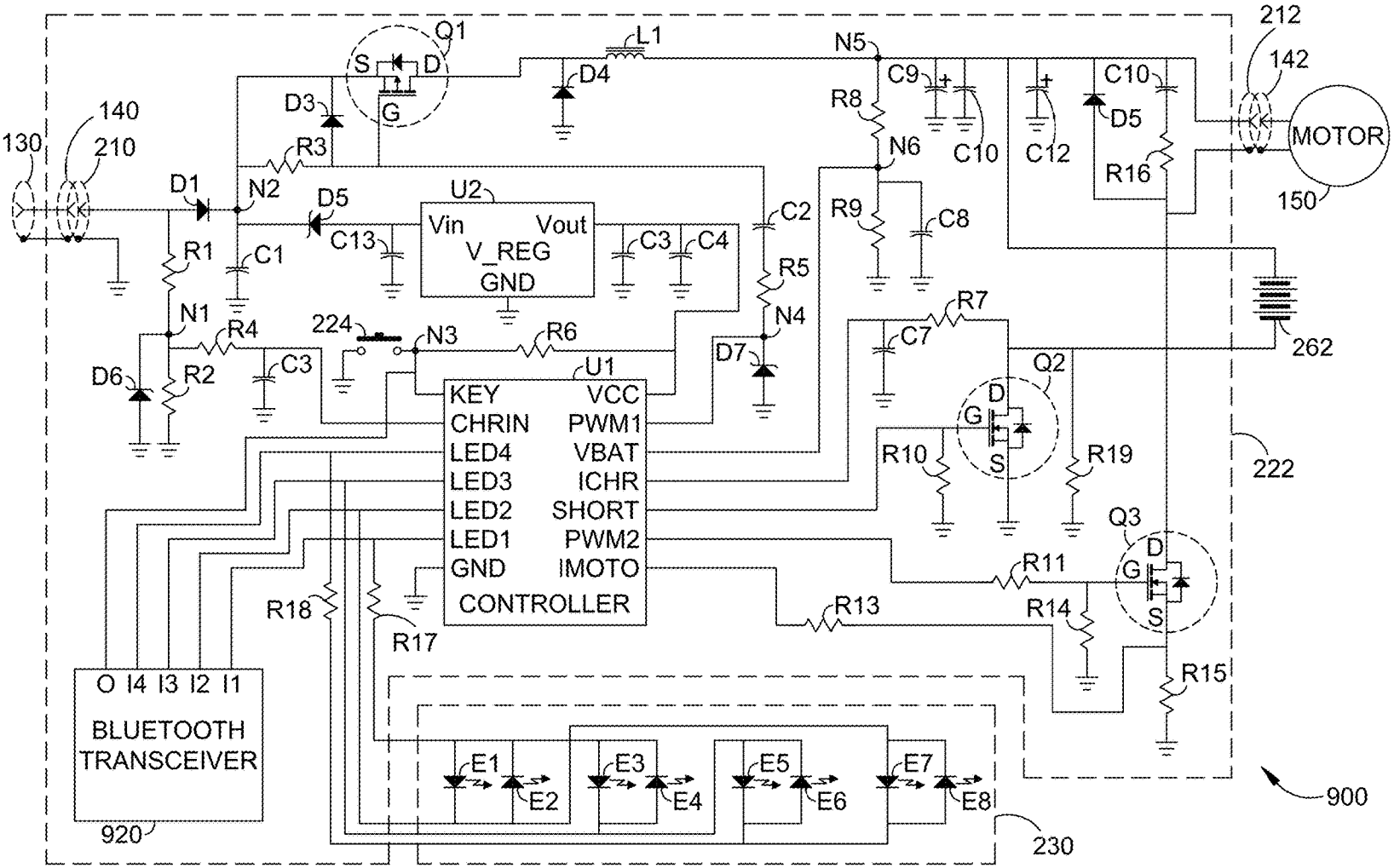
FIG. 28 illustrates a schematic diagram of an electronic circuit for controlling the operation of the fitness ball of FIGS. 1-23.

FIG. 28 illustrates a schematic diagram of an electronic circuit 900 that controls the operation of the fitness ball 100 shown in FIGS. 1-23. One skilled in the art will appreciate that the operation of the fitness ball can be controlled by other circuits implemented with different combinations of components. In the schematic diagram, components corresponding to components described in FIGS. 1-23 are identified with corresponding element numbers. The electronic components (e.g., resistors, capacitors, transistors and the like) are identified with alphanumeric designations in a conventional manner (e.g., Rn for resistors, Cn for capacitors, Qn for transistors, Un for integrated circuits, and the like).

The circuit 900 is controlled by a control unit U1, which may be implemented with a microcontroller, implemented with a custom application specific integrated circuit (ASIC), or implemented with other custom circuitry. In the illustrated embodiment, the control unit is a 14-pin programmable microcontroller with flash program memory, such as, for example, a PIC16(L)F1824 microcontroller commercially available from Microchip Technology, Inc. The functions and operations of the device are well known and are not described herein except for the applications of the functions and operations with respect to the circuit in FIG. 28.

The control unit U1 includes a power input (VCC) pin and a ground (GND) pin. The control unit further includes twelve input/output pins. Each pin is programmable to provide selected functionality as fully described in the "14/20-Pin Flash Microcontrollers with XLP Technology" published on Jan. 27, 2015, by Microchip Technology Inc. In the illustrated embodiment, the pins of the control unit U1 are programmed as described in the following paragraphs.

A KEY pin of the control unit U1 is configured as a digital input pin. The control unit U1 senses the presence of a logic high signal (e.g., +5 volts) or a logic low signal (e.g., 0 volts (ground)) on the KEY pin and performs selected operations in response to the logic level on the pin. As described in more detail below, the KEY input pin is connected to the switch 224.

A CHRIN pin of the control unit U1 is configured as a digital input pin. The control unit U1 senses the logic level on the CHRIN pin to determine whether a charging voltage source is connected to the circuit 900 via the power adapter jack assembly 130.

An LED1 drive pin, an LED2 drive pin, an LED3 drive pin and an LED4 drive pin of the control unit U1 are configured as digital output pins. Each drive pin can generate a high (e.g., +5 volts) output signal as a source of current, can generate a low (e.g., ground) output signal to sink current, or can be tri-stated so the drive pin does not source current and does not sink current.

A PWM1 pin of the control unit U1 is configured as a digital output pin. As described below, the control unit U1 generates pulses on the PWM1 pin to control the charging of the battery cell pack 262.

A VBAT pin of the control unit U1 is configured as an analog input pin. The VBAT pin receives an analog voltage that is responsive to the voltage of the battery cell pack 262.

An ICHR pin of the control unit U1 is configured as an analog input pin. The ICHR pin receives an analog voltage that is responsive to the magnitude of a current flowing through the battery cell pack 262 when the battery cell pack is charging.

An SHORT pin of the control unit U1 is configured as a digital output pin. The SHORT pin is controlled by the control unit U1 to produce a signal that selectively modifies a current path to ground from the negative terminal of the battery cell pack 262.

A PWM2 pin of the control unit U1 is configured as a digital output pin. As described below, the control unit U1 generates pulses on the PWM2 pin to control the rotational speed of the motor 150.

An IMOTO pin of the control unit U1 is configured as an analog input pin. The IMIOTO pin receives an analog voltage responsive to the current flowing through the motor 150.

The control unit U1 includes internal flash memory (not shown) that is programmed to respond to changes in the signals received on the input pins and to generate signals on the output pins to control the functions of the circuit 900 as described in the following paragraphs.

A first portion of the circuit 900 operates as charge input circuit. The charge input circuit comprises the power adapter jack assembly 130 that removably receives a plug (not shown) from a conventional power adapter (not shown). In the illustrated embodiment, the power adapter provides 16.8 volts DC to a voltage pin with respect to a ground pin. As discussed above, the power adapter jack assembly is electrically coupled to the circuit on the printed circuit board 222 via the first barrel jack 140 and the first barrel plug 210.

The voltage pin of the power adapter jack assembly 130 is electrically connected to the anode of a first power Schottky rectifier diode D1 and to a first terminal of a resistor R1. A second terminal of the resistor R1 is connected to a first terminal of a resistor R2 and to the cathode of a Zener diode D6 at a first node N1. A second terminal of the resistor R2 and the anode of the Zener diode are connected to the common ground. The resistor R1 and the resistor R2 operate as a voltage divider to provide approximately ⅓ of the input voltage at the first node N1. The Zener diode further limits the voltage at the first node N1 to approximately 5.2 volts.

The voltage at the first node N1 is provided through a resistor R4 to the CHRIN input pin of the control unit U1. A small filter capacitor C3 connected between the CHRIN input pin and the common ground reduces noise on the voltage on the CHRIN input pin. When voltage on the CHRIN input pin is high (approximately 5.2 volts), the control unit U1 detects that an AC/DC adapter is connected to the power adapter jack assembly 130 and is providing an input voltage to the circuit 900. The control unit responds to the presence of the input voltage to operate a battery charging portion of the circuit as described below.

The cathode of the Schottky rectifier diode D1 provides a source of DC voltage to a second node N2 to operate the circuit 900 and to charge the battery cell pack 262. In the illustrated embodiment, the diode D1 is an SK24 diode commercially available from Unisonic Technologies Co., Ltd., of New Taipei City, Taiwan, and from other sources. The diode D1 has a maximum forward voltage drop of 0.5 volt. Thus, the voltage at the node N2 is approximately 16.1 volts. The diode D1 further operates to inhibit a reverse current flow from the node N2 to the first terminal of the resistor R1. When the AC/DC adapter is not present and the battery cell pack is providing the operating voltage to the circuit, as described below, the reverse-biased diode D1 prevents the battery-supplied voltage from causing a high input signal on the CHRIN input pin of the control unit U1.

The node N2 is connected to the cathode of a Zener diode D5. The anode of the Zener diode D5 is connected to the input (Vin) pin of a voltage regulator U2. In the illustrated embodiment, the Zener diode D5 has a Zener voltage of approximately 3 volts such the voltage on the input pin of the voltage regulator is approximately 13.1 volts. A small filter capacitor C13 between the input pin and the common ground reduces noise on the voltage provide to the input pin. In the illustrated embodiment, the voltage regulator U2 provides approximately 5 volts on an output pin (Vout) when the input voltage has a magnitude within a range of approximately 7-20 volts. In the illustrated embodiment, the voltage regulator is a commercially available HT7550 voltage regulator from Holtek Semiconductor Inc., of Taipei, Taiwan. Other regulators from other sources may also be used.

The regulated 5-volt output voltage from the voltage regulator U2 is provided as the supply voltage to the VCC input of the control unit U1. A filter capacitor C3 and a filter capacitor C4 reduce noise on the regulated output voltage. The regulated output voltage is also provided to a first terminal of a resistor R6. A second terminal of the resistor R6 is provided to a first terminal of the pushbutton switch 224 at a third node N3. A second terminal of the pushbutton switch is connected to the common ground. In the illustrated embodiment, the pushbutton switch is a momentary contact switch, and the contacts are normally open. The third node N3 is connected to the KEY input pin of the control unit U1. The resistor R6 functions as a pull-up resistor to cause the third node N3 and the KEY input pin to be maintained at the magnitude of the supply voltage to the VCC input of the control unit unless the pushbutton switch is activated to close the momentary contacts. Thus, the control unit U1 detects the value at the KEY input pin as a logic high signal while the pushbutton switch is inactive. When the pushbutton switch is activated to close the contacts, the third node N3 is grounded to cause the voltage on the third node N3 to switch to approximately zero volts. The control unit U1 detects the value at the KEY input pin as a low logic level. The control unit U1 is responsive to the KEY input pin being at the low logic level to selectively activate functions described below.

The input voltage on the node N2 is also provided to the source (3) terminal of a power MOSFET (metal-oxide-semiconductor field-effect transistor) Q1. The power MOSFET Q1 has a drain (D) terminal and a gate (G) terminal. In the illustrated embodiment, the MOSFET Q1 is a P-Channel enhancement mode field-effect transistor in which current flows from the source terminal to the drain terminal when the voltage on the gate terminal is sufficiently negative with respect to the source terminal to cause the drain-to-source on-resistance to be low (e.g., between 20 milliohms and 30 milliohms). For example, in the illustrated embodiment, the MOSFET Q1 is a commercially available STP4435 MOSFET from Stanson Technology of Mountain View, Calif., or a similar device from another source. The MOSFET Q1 is turned on when the gate-to-source voltage is at least −4.5 volts (i.e., gate voltage is lower (more negative) than the source voltage by at least 4.5 volts) to enable current to flow from the source to the drain.

The gate terminal of the MOSFET Q1 is biased to a high voltage level by a pull-up resistor R3 having a first terminal connected to the gate terminal and having a second terminal connected to the node N2. The anode of a diode D3 is connected to the gate terminal of the MOSFET Q1, and the cathode of the diode D3 is connected to the source terminal of the MOSFET Q1. The diode D3 prevents the voltage on the gate terminal of the MOSFET Q1 from exceeding the voltage on the source terminal by more than one diode forward voltage drop (e.g., approximately 0.7 volt). The resistor R3 is also part of a pulse generation circuit described below.

The gate terminal is connected to a first terminal of a capacitor C2. A second terminal of the capacitor C2 is connected to a first terminal of a resistor R5. A second terminal of the resistor R5 is connected to the cathode of a Zener diode D7 at a fourth node N4. The anode of the Zener diode D7 is connected to the common ground. The fourth node N4 is connected to the PWM1 output of the control unit U1. In the illustrated embodiment, the Zener diode has a Zener voltage of approximately 5.2 volts; the resistor R3 has a resistance of approximately 22,000 ohms; the capacitor C2 has a capacitance of approximately 10,000 picofarads; and the resistor R5 has a resistance of approximately 47 ohms.

The capacitor C2 and the resistor R3 function as a negative pulse generator circuit activated by the PWM1 output of the control unit U1. The inactive level of the PWM1 output is high (e.g., approximately 5 volts). While the PWM1 output is high, the capacitor C2 charges to approximately 11.1 volts (e.g., 16.1 volts−5 volts). The voltage on the gate of the MOSFET Q1 is at approximately 16.1 volts during this time. Each time, the PWM1 output is switched from the high level to the low level (e.g., 0 volt), the voltage on the node N4 rapidly decreases from approximately 5 volts to approximately 0 volts. Because the voltage across the capacitor cannot change instantaneously, a voltage drop of 5 volts develops initially across the resistor R3, which causes the voltage on the gate of the MOSFET Q1 to drop by approximately 5.2 volts to approximately 10.9 volts. The lower voltage causes the gate-to-source voltage to be approximately −5 volts. This negative voltage is sufficient to cause the MOSFET Q1 to conduct from the source to the drain. Note that the resistance of the resistor R5 is significantly smaller than the resistance of the resistor R3 such that the voltage drop across the resistor R5 is not a factor.

The capacitor C2 charges through the resistor R3 and the resistor R5 until the voltage across the capacitor reaches 16.1 volts, which causes the magnitude of the negative gate-to-source voltage applied to the MOSFET Q1 to decrease from approximately 5 volts to approximately 0 volt. The drain-to-source resistance increases as the magnitude of the gate-to-source voltage decreases such that the source-to-drain current reduces and is cut off when the magnitude of the gate-to-source voltage is in a range between 2.5 volts and 2 volts. The current remains cut off as the magnitude of the voltage continues to decrease. The duration of the conductivity of the MOSFET Q1 thus depends on the time constant of the capacitor C2 and the resistor R3. The resistor R5 has an insignificant effect on the time constant. When the PWM1 output of the control unit U1 switches back to the high level, the voltage across the capacitor C2 cannot change instantaneously, and the voltage on the gate of the MOSFET Q1 would increase to a positive value with respect to the source voltage. The diode D3 prevents the gate voltage from exceeding the source voltage by more than 0.7 volts. The capacitor C2 discharges rapidly from 16.1 volts to 11.1 volts through the diode D3 and the resistor R5.

The Zener diode D7 prevents the voltage on the PWM1 output pin of the control unit U1 from exceeding 5.2 volts at any time during the charging and discharging of the capacitor C3.

The drain of the MOSFET Q1 is connected to a first terminal of an inductor L1, which is a 33-microhenry inductor in the illustrated embodiment. The drain is also connected to the cathode of a Schottky barrier rectifier D4, which has an anode connected to the common ground. The second terminal of the inductor L1 is connected to a fifth node N5. Respective first terminals of a capacitor C9, a capacitor C10 and a capacitor C12 are connected to the node N5. Respective second terminals of the capacitors C9, C10 and C12 are connected to the common ground. In the illustrated embodiment, the capacitors C9 and C12 are polarized filter capacitors having capacitances of approximately 22 microfarads. The capacitor C10 is an unpolarized filter capacitor having a capacitance of approximately 100,000 picofarads (0.1 microfarad).

The node N5 is also connected to the positive terminal of the battery cell pack 262. The negative terminal of the battery cell pack is connected to a first terminal of a resistor R19. A second terminal of the resistor R19 is connected to the common ground. In the illustrated embodiment, the resistor R19 has a resistance of approximately 0.1 ohm (100 milliohms). In other embodiments, the resistor R19 may be implemented as two parallel resistors, each having a resistance of approximately 0.2 ohm, to reduce the power dissipated by a single resistor. Other components connected to the node N5 and to the negative terminal of the battery cell pack are described below.

The MOSFET Q1, the diode D4, the inductor L1, the capacitors C9, C10 and C12, and the resistor R19 are configured to operate as a buck switching power supply. As described above, when the MOSFET Q1 is turned on, the MOSFET conducts current from the source to the drain for a selected time duration each time the PWM1 signal switches from the high level to the low level. The current from the drain of the MOSFET passes through the inductor L1 to the node N5 to charge the capacitors C9, C10 and C12. When the MOSFET is turned off, no current is provided from the drain of the MOSFET; however, current continues to flow through the inductor L1 via the diode D4, which operates as a "freewheeling" diode. Thus, current continues to charge the capacitors for at least a portion of the time when the MOSFET is turned off. The voltage developed across the capacitors is applied to the terminals of the battery cell pack 262 to charge the battery cell pack. The total amount of current available to charge the battery is determined by the rate at which the MOSFET is switched on and off. Accordingly, the battery charging current is adjusted by modifying the PWM1 output of the control unit U1.

When the AC/DC adapter (not shown) is attached to the power adapter assembly 130 to provide the DC input voltage to the circuit 900, the voltage level at the CHRIN input pin of the control unit U1 is high. The control unit U1 responds to the high input level on the CHRIN input to generate pulses on the PWM1 output pin. The widths of the pulses on the PWM1 output pin are controlled to control the rate at which the battery cell pack 262 is charged. The control unit monitors the voltage across the battery by monitoring the voltage between the node N5 and the common ground via a voltage sensing circuit. The voltage sensing circuit comprises a resistor R8 having a first terminal connected to the node N5 and having a second terminal connected to a first terminal of a resistor R9 at node N6. A second terminal of the resistor R9 is connected to the common ground. In the illustrated embodiment, the resistor R8 has a resistance of approximately 160,000 ohms, and the resistor R9 has a resistance of approximately 20,000 ohms such that the voltage at the node N6 is approximately 11.1 percent of the voltage on the node N5, which corresponds to the voltage of the battery cell pack.

The node N6 is connected to the VBAT input of the control unit U1. As discussed above, the VBAT input is configured as an analog input and is coupled to an internal analog-to-digital (A/D) converter. The A/D converter converts the analog input to a digital value, which is monitored by the control unit to determine the instantaneous voltage at the node N6 and thus determine the voltage of the battery cell pack 262. The control unit is programmed to discontinue the charging operation when the battery voltage reaches a selected predetermined level. The control unit may also be programmed to gradually reduce the charging rate as the battery voltage approaches the selected predetermined level.

The resistor R19 functions as a current sensor to enable the control unit U1 to monitor the current flowing through the battery cell pack 262 as the battery is charging. The charging current flows through the resistor R19. The resistance of the resistor R19 is sufficiently small (e.g., 100 milliohms) that the resistor does not reduce the charging voltage significantly. The charging current causes a small voltage to develop across the resistor R19 (e.g., 100 millivolts at a charging current of 1 amp). The voltage developed across the resistor R19 is proportional to the current flowing through the resistor and is thereby proportional to the current charging the battery cell pack. The voltage is provided as in input to the ICHR input of the control unit U1 via a resistor R7. In the illustrated embodiment, the resistor R7 has a resistance of approximately 10,000 ohms, which is significantly greater than the sensing resistor R19 such that the resistor R7 does not affect the voltage developed across the sensing resistor. A filter capacitor C7, having a capacitance of, for example, 0.01 microfarad, is connected between the ICHR input and the common ground to reduce noise on the signal. The ICHR input is configured as an analog input and is coupled to an internal analog-to-digital (A/D) converter. The A/D converter converts the analog input to a digital value, which is monitored by the control unit to determine the instantaneous current flowing through the sensing resistor R19 and thus determine the charging current through the battery cell pack. The control unit is programmed to discontinue the charging operation when the charging current is 0 or at a predetermined level close to 0. The control unit may also be programmed to discontinue the charging operation if the charging current exceeds a predetermined maximum amount, which may indicate a potential failure of the battery cell pack.

The current sensing resistor R19 can be selectively bypassed by a second MOSFET Q2. In the illustrated embodiment, the second MOSFET Q2 is an N-Channel enhancement mode power field effect transistor, such as, for example, a commercially available ST2300 MOSFET from Stanson Technology of Mountain View, Calif., or a similar device from another source. The source (S) of the MOSFET Q2 is connected to the common ground. The drain (D) is connected to the first terminal of the resistor R19. The gate (G) is connected to the SHORT output pin of the control unit U1. The gate is also connected to a first terminal of a resistor R10. A second terminal of the resistor R10 is connected to the ground reference. In the illustrated embodiment, the resistor R10 has a resistance of approximately 10,000 ohms. When the signal on the SHORT output is inactive (e.g., low, ground or floating), the MOSFET Q2 is off. The resistor R10 assures that the gate voltage is low if the SHORT output pin is floating. When the signal on the SHORT pin is activated to a high level, the MOSFET Q2 is turned on to effectively impose the drain-to-source resistance (RDS) across the sensing resistor R19. The low drain-to-source resistance of approximately 48 milliohms reduces the voltage drop in the ground path from the negative terminal of the battery cell pack 262. For example, the signal on the SHORT pin is activated except when the control unit U1 is monitoring the charging current through the battery cell pack to reduce the power loss in the ground path during the charging process.

The MOSFET Q1 in the buck switching supply includes an internal bypass diode connected with the anode at the drain (D) terminal and with the cathode at the source (S) terminal. When the MOSFET Q1 is turned off, the bypass diode allows current to flow from the drain to the source (i.e., in the opposite direction the current flow when the MOSFET Q1 is turned on). The internal bypass diode provides a path for providing an input voltage to the voltage regulator U2 when no external power adapter is connected to the first power adapter jack assembly 130. In particular, current from the positive terminal of the battery cell pack 262 is coupled via the node N5 and the inductor L1 to the drain terminal of the MOSFET Q1. The current passes through the bypass diode to the source terminal and thus to the node N2. The voltage at the node N2 is thus one forward diode drop (approximately 0.8 to 1.0 volt) below the battery voltage. This voltage is provided to the input (Vin) of the voltage regulator U2 via the Zener diode D5. Thus, when the power adapter is not connected, the battery cell pack provides the operating voltage for the electronic components of the circuit 900.

The electric motor 150 is controlled by the signal on the PWM2 output pin of the control unit U1. The PWM2 is selectively activated to provide a high-level output signal at a frequency and duty cycle selected to drive the motor at one of the three selected rotation rates discussed above. Additional rotation rates can be provided in alternative embodiments. The PWM2 output pin is connected to a first terminal of a resistor R11. The second terminal of the resistor R11 is connected to the gate (G) of a third MOSFET Q3 and to the first terminal of a resistor R14. A second terminal of the resistor R14 is connected to the ground reference. The resistor R11 has a resistance of approximately 12 ohms. The resistor R14 has a resistance of approximately 10,000 ohms. The resistor R11 and the resistor R14 operate as a voltage divider wherein the voltage applied to the gate of the MOSFET Q3; however, because the resistor R14 is three orders of magnitude greater than the resistance of the resistor R11 substantially all of the voltage on the PWM2 output pin is effectively applied to the gate of the MOSFET Q3. Thus, when the PWM2 output pin has an active signal of approximately 5 volts, the MOSFET Q2 is turned on and has a drain-to-source on resistance RDS(ON) of less than approximately 20 milliohms.

The source (5) of the MOSFET Q3 is connected to a first terminal of a resistor R15. A second terminal of the resistor R15 is connected to the ground reference. The source of the MOSFET Q3 and the first terminal of the resistor R15 are connected to a first terminal of a resistor R13. A second terminal of the resistor R13 is connected to the IMOTO input pin of the control unit U1. In the illustrated embodiment, the resistor R15 has a resistance of approximately 50 milliohms; and the resistor R13 has a resistance of approximately 10,000 ohms. When current is flowing from the source to the ground reference, a voltage develops across the resistor R15 proportional to the current. The resistor R13 couples the developed voltage to the IMOTO input pin. An internal A/D converter within the control unit U1 converts the voltage to a digital value so that the control unit is enabled to monitor the current flowing through the resistor R15.

The motor 150 is connected to the circuit 900 via the second barrel plug 212 and the second barrel jack 142. A first terminal of the motor is connected to the node N5. Thus, the motor is connected to the positive terminal of the battery cell pack 262. A second terminal of the motor is connected to the drain (D) of the MOSFET Q3. When the MOSFET Q3 is turned on by the PWM2 signal applied to the gate (G), current flows from the positive terminal of the battery cell pack to the node N5 and to the first terminal of the motor. The current returns from the second terminal of the motor through the MOSFET Q3 and through the resistor R15 to the ground reference. The current returns to the negative terminal of the battery cell pack through the resistor R19 (or through the parallel combination of the resistor R19 and the MOSFET Q2).

Because the only path for the return current from the motor 150 to the battery cell pack 262 is through the MOSFET Q3, current only flows through the motor when the MOSFET Q3 is turned on. The gate (G) of the MOSFET Q3 is controlled by the PWM2 output of the control unit U1 to vary the widths of the pulses applied to the motor to vary the average voltage applied to the motor. For example, the signal from the PWM2 output may be controlled to provide a first pulse width (e.g., a duty cycle of one-third) to produce a first average voltage to operate the motor at a first (low) rotational speed; may be controlled to provide a second pulse width (e.g., a duty cycle of two-thirds) to produce second (higher) average voltage to operate the motor at a second (medium) rotational speed; and may be controlled to provide a third pulse width (e.g., at or close to unity duty cycle) to produce a third (highest) average voltage to operate the motor at a third (high) rotational speed. As discussed above, each rotational speed of the motor corresponds to a vibration frequency caused by the eccentric masses 152, 154. Thus, the vibration frequency of the ball is controlled by the PWM2 output of the control unit U1.

The circuit 900 further includes a freewheeling diode D5 with a cathode connected to the node N5 (e.g., to the first terminal of the motor 150) and with an anode connected to the second terminal of the motor. Thus, the diode D5 is connected across the terminals of the motor. The diode D5 has no effect when the motor is turned on by current flowing through the MOSFET Q3 because the diode D5 is reverse biased. When the MOSFET Q3 is turned off, the current flowing through the inductive windings of the motor is allowed to dissipate through the diode D5. A capacitor C10 and a resistor R16 are connected in series across the anode and cathode of the diode D5. The capacitor C10 and the resistor R16 suppress noise across the motor terminals. In the illustrated embodiment, the diode D5 is an SK34 Schottky rectifier commercially available from Sangdest Microelectronics of Nanjing, China, or a similar device from other sources; the capacitor C10 is a 0.01 microfarad capacitor; and the resistor R16 is a 12 ohm resistor.

The status of the operation of the circuit 900 is displayed to a user via the eight light-emitting diodes (LEDs) 240A-H. The LEDs are described above in connection with FIG. 7, for example. The LEDs are identified in FIG. 28 as a first LED E1, corresponding to the LED 240A; a second LED E2, corresponding to the LED 240B; a third LED E3, corresponding to the LED 240C; a fourth LED E4, corresponding to the LED 240D; a fifth LED E5, corresponding to the LED 240E; a sixth LED E6, corresponding to the LED 240F; a seventh LED E7, corresponding to the LED 240G; and an eighth LED E8, corresponding to the LED 240H. As discussed above, the LED E1 is a red LED; the LEDs E2, E3, E4 and E5 are green LEDs; and the LEDs E6, E7 and E8 are blue LEDs.

The LED1 input/output pin from the control unit C1 is connected to a first terminal of a resistor R17. A second terminal of the resistor R17 is connected to the anode of the LED E1, the cathode of the LED E2, to the anode of the LED E3, and to the cathode of the LED E4.

The LED2 input/output pin is connected to the cathode of the LED E1, to the anode of the LED E2, to the anode of the LED E7 and to the cathode of the LED E8.

The LED3 input/output pin is connected to the cathode of the LED E3, to the anode of the LED E4, to the anode of the LED E5 and to the cathode of the LED E6.

The LED4 input/output pin is connected to a first terminal of a resistor R18. A second terminal of the resistor R18 is connected to the cathode of the LED E5, to the anode of the LED E6, to the cathode of the LED E7 and to the anode of the LED E8.

In the illustrated embodiment, each of the resistor R17 and the resistor R18 has a respective resistance of approximately 470 ohms such that approximately 9 milliamps of current flows through a selected one of the LEDs when activated as described below.

Only a selected one of the LEDs is activated at any time by activating two of the signals in the input/output pins LED1, LED2, LED3, LED4 as follows. As described above, each of the four input/output pins can be switched to a low (e.g., ground) state or to a high (e.g., approximately 5-volt) state or to a tri-state. When a pin is switched to the tri-state condition, the pin does not source current and does not sink current. Each of the four input/output pins is maintained in its respective tri-state condition unless specifically activated in accordance with the following description.

When the LED1 input/output pin is switched to an active high state, either the first LED E1 or the third LED E3 is turned on. The LED E1 is turned on if the LED2 input/output pin is switched to a low state. The LED E3 is turned on if the LED3 input/output pin is switched to a low state.

When the LED2 input/output pin is switched to an active high state, either the second LED E2 or the seventh LED E4 is turned on. The LED E2 is turned on if the LED1 input/output pin is switched to a low state. The LED E7 is turned on if the LED4 input/output pin is switched to a low state.

When the LED3 input/output pin is switched to an active high state, either the fourth LED E4 or the fifth LED E5 is turned on. The LED E4 is turned on if the LED1 input/output pin is switched to a low state. The LED E5 is turned on if the LED4 input/output pin is switched to a low state.

When the LED4 input/output pin is switched to an active high state, either the sixth LED E6 or the eighth LED E8 is turned on. The LED E3 is turned on if the LED3 input/output pin is switched to a low state. The LED E8 is turned on if the LED2 input/output pin is switched to a low state.

Although only one of the LEDs should be turned on at the same time, the control unit U1 can activate the LEDs in a rapid sequence to provide the appearance of multiple LEDs being activated. For example, the four green LEDs E2, E3, E4, E5 can be activated with non-overlapping 25 percent duty cycles each to provide the appearance that the four LEDs are on at the same time.

The control unit U1 monitors the level of the CHRIN input pin to determine whether the external power adapter is providing voltage to the power adapter jack assembly 130 (the signal on CHRIN pin is high) or whether the external power adapter is either disconnected or is off (the signal on the CHRIN pin is low). If the CHRIN input level is low, the control unit does not perform the charging operation described below.

When the control unit U1 determines that the CHRIN input level the control unit senses the voltage level of the signal on the VBAT input pin and the voltage level on the ICHR pin to determine the status of the charging circuitry. If the level on the VBAT input is at or above a level corresponding to a desired battery voltage, the control unit turns off the charging operation. If the level on the VBAT pin is below a level corresponding to the desired battery voltage, the control unit determines whether the voltage level on the ICHR pin exceeds a maximum level to verify the charging current is not too high. If the charging current exceeds the maximum level, the control unit turns off the charging operation.

If the level on the VBAT input pin and the level on the ICHR input pin are both acceptable, the control unit turns on an internal pulse generator to provide a pulsed output signal on the PWM1 output pin to operate the buck switching power supply as described above. In one embodiment, the pulsed output signal may be maintained at a constant duty cycle until the desired battery voltage is achieved. In other embodiments, the duty cycle of the pulsed output signal may be varied in accordance with the difference between the sensed battery voltage level and the desired battery voltage level so that the charging rate is reduced as the voltage of the battery cell pack 262 approaches the desired battery voltage. The charging process is discontinued if the sensed charging current exceeds a maximum level.

If the charging process is discontinued when one of the sensed inputs exceeds a respective maximum level, the charging process can resume when both sensed inputs are again below the respective maximum levels.

In the illustrated embodiment, during the charging process, the control unit C1 activates the signals on the LED1, LED2, LED3 and LED4 output pins to sequentially activate the E1, E2, E3, E4 and E5 LEDs in a red-green-green-green-green sequence that is repeated approximately 20 times per minute to indicate that the battery cell pack 262 is being charged. When the charging process is completed the five LEDs are all activated at the same time (e.g., by applying a non-overlapping 20 percent duty cycle to each of the five LEDs) to indicate that the charging process is complete.

If the charging adapter is removed from the power adapter jack assembly 130 and the circuit 900 is operated to drive the motor 150 to thereby cause the battery cell pack 262 to discharge, the control unit monitors the voltage level on the VBAT input pin and activates selected ones of the E1, E2, E3, E4 and E5 LEDs to indicate the charge state. For example, the five LEDs may be activated when the magnitude of the battery voltage is in a highest range of voltages. Only four LEDs (e.g., the LEDs E1, E2, E3 and E4) may be activated when the voltage is in a second (next highest) range of magnitudes. Only three LEDs (e.g.; the LEDs E1 E2 and E3) may be activated when the voltage is in a third range of magnitudes. Only two LEDs (e.g., the LEDs E1 and E2) may be activated when the voltage is in a fourth range of magnitudes. Only the red LED E1 is activated with the voltage is below the fourth range of magnitudes to indicate to the user that the system should be connected to the charging adapter.

The control unit U1 is responsive to the activation of the normally open pushbutton switch 224. When the pushbutton switch is activated, the signal on the KEY input pin is brought to the low (ground reference) level until the pushbutton switch is released. The control unit monitors the duration of the activation of the push button. If the low signal level on the KEY input pin lasts for at least approximately three seconds before returning to the high level, the control unit determines switches the power condition of the circuit 900. If the power was previously off, the power is turned on. If the power was previously on, the power is turned off. Note however that when the power is turned off, the control unit enters a low power consumption sleep mode such the KEY input signal continues to be monitored. When the KEY input signal is activated again, the control unit "awakens" and resumes operation.

If the power is already on (e.g., control unit U1 is awake), activation of the pushbutton switch 224 by less than approximately 3 seconds causes the control unit to control the operation of the motor 150. For example, if the motor is not running, the control unit responds to the first activation of the switch to activate the pulsed signal on the PWM2 output line at a first duty cycle to cause the motor to operate at the first rotational speed and thus produce vibrations at the first frequency. The control unit responds to the second activation of the switch to activate the pulsed signal on the PWM2 output line at a second duty cycle to cause the motor to operate at the second rotational speed and thus produce vibrations at the second frequency. The control unit responds to the third activation of the switch to activate the pulsed signal on the PWM2 output line at a third duty cycle to cause the motor to operate at the third rotational speed and thus produce vibrations at the third frequency. The control unit responds to the fourth activation of the switch to discontinue sending pulses on the PWM2 output line to cause the motor to stop rotating. Further short activations of the pushbutton switch sequences the motor through the three rotational speeds and the off state. Activation of the switch for at least three seconds at any time will turn the motor off and cause the control unit to enter the sleep state.

While the motor 150 is activated, the control unit C1 monitors the level on the IMOTO input pin to determine the magnitude of the current flowing through the motor. If the sensed level exceeds a level corresponding to an unsafe current level, the control unit discontinues outputting the pulsed signals on the PWM2 output pin.

The control unit U1 controls the blue LEDs E6, E7 and E8 to indicate the selected rotational speed that corresponds to a selected vibration frequency. For example, only one of the blue LEDs (e.g., the LED E6) is activated to indicate that the motor 150 is rotating at the lowest speed/frequency level. Two of the blue LEDs (e.g., the LED E6 and the LED E7) are activated to indicate that the motor is operating at the medium level. All three blue LEDs E6, E7, E8 are activated to indicate the motor is rotating at the high level. When all three blue LEDs are activated when the battery cell pack 262 is fully charged, the eight LEDs are all activated with non-overlapping 12.5 percent duty cycles to provide the appearance that the eight LEDs are all on at the same time.

Although described above with varying duty cycles in accordance with the number of LEDs to be activate at the same time, in certain embodiments, each LED is always activated with a 12.5 percent duty cycle such that the brightness level of the each LED is constant irrespective of whether the LED is activate alone or in combination with one or more other LEDs.

As further shown in FIG. 28, the vibrating fitness ball 100 may be controlled by a Bluetooth interface to a smartphone or other Bluetooth compatible interface (not shown). For example, one embodiment, the electronics circuit 900 includes a Bluetooth transceiver module 920 that has at least one output, O, coupled to the KEY input of the controller U1. The output of the Bluetooth transceiver module operates in parallel to the pushbutton switch 224 to selectively pull the KEY input to ground to provide command signals to the controller. Although shown as a direct connection between the output of the Bluetooth transceiver and the KEY input in FIG. 28, the output of the Bluetooth transceiver may be buffered (e.g., using a MOSFET similar to the MOSFET Q2) to reduce the current sinking requirements of the output.

As further illustrated in FIG. 28, the Bluetooth transceiver 920 has a plurality of inputs 11, 12, 13, and 14 connected to the LED1, LED2, LED3, and LED4 outputs, respectively, of the controller U1. The controller may selectively activate one or more of the four outputs to apply data to the inputs of the Bluetooth transceiver to communicate with the smartphone or other Bluetooth compatible interface. For example, when one of the LEDs E1-E8 is activated, the combination of outputs from the controller is communicated via the Bluetooth transceiver to the smartphone or other Bluetooth compatible interface to relay the current status of the vibrating fitness ball 100 to the user even if the ball is positioned in a location where the LEDs cannot be readily observed by the user. As described above, eight high-low combinations of the LED1, LED2, LED3, and LED4 outputs control the eight LEDs. Accordingly, four additional combinations of the four outputs (e.g., LED1 high/LED4 low; LED2 high/LED3 low; LED3 high/LED2 low; and LED4 high/LED1 low) are available to communicate additional information from the controller to the smartphone or other Bluetooth compatible interface. For example, upon powering up, the controller may initiate a Bluetooth pairing protocol to enable the vibrating fitness ball to be paired with a new smartphone or other device.

When the vibrating fitness ball 100 is operated with a smartphone or other Bluetooth compatible device, the smartphone or other device may be programmed with an app or other program to transmit a sequence of commands to the vibrating fitness ball to selectively increase and decrease the vibration rate in accordance with a desired fitness or therapeutic routine. Thus, the user may concentrate on his or her physical action with respect to the fitness or therapeutic routine while the app controls the vibration of the fitness ball.

As various changes could be made in the above constructions without departing from the scope of the invention, it is intended that all the matter contained in the above description or shown in the accompanying drawings shall be interpreted as illustrative and not in a limiting sense.

What is claimed is:

1. A portable vibration generation apparatus comprising:

a first hemispherical shell having an outer surface and an inner surface, the inner surface of the first hemispherical shell including at least one motor support structure;

a second hemispherical shell having an outer surface and an inner surface, the inner surface of the second hemispherical shell including at least one battery support structure and at least one circuit board support structure, the second hemispherical shell mechanically coupleable to the first hemispherical at an equatorial plane to form a spherical ball;

a motor positioned on the motor support structure of the first hemispherical shell and secured to the motor support structure to inhibit movement of the motor with respect to the motor support structure, the motor intersecting the equatorial plane, the motor having a shaft having a first end and a second end, the shaft parallel with and offset from the equatorial plane such that the shaft is located entirely within the first hemispherical shell;

a first eccentric mass secured to the first end of the shaft, and a second eccentric mass secured to the second end of the shaft;

a battery assembly secured to the battery support structure of the second hemispherical shell;

a circuit board assembly secured to the circuit board support structure of the second hemispherical shell, the circuit board assembly electrically connected to the battery assembly to receive electrical energy from the battery assembly, the circuit board assembly generating a motor drive signal; and at least a first electrical connector and at least a second electrical connector, the first and second electrical connectors engageable when the first hemispherical shell is coupled to the second hemispherical shell, the connectors communicating the motor drive signal from the circuit board assembly to the motor.

2. The portable vibration generation apparatus as defined in claim 1, wherein the motor is positioned in the first hemispherical shell and wherein the battery assembly and the circuit board assembly are positioned in the second hemispherical shell such that a center of gravity of the spherical ball is near the equatorial plane.

3. The portable vibration generation apparatus as defined in claim 1, further including a first outer cover positioned over the first hemispherical shell and a second outer cover positioned over the second hemispherical shell.

4. The portable vibration generation apparatus as defined in claim 3, wherein:

the first hemispherical shell and the first outer cover include respective patterns of interlocking features that inhibit movement of the first outer cover with respect to the first hemispherical shell when the first outer cover is positioned on the first hemispherical shell; and the second hemispherical shell and the second outer cover include respective patterns of interlocking features that inhibit movement of the second outer cover with respect to the second hemispherical shell when the second outer cover is positioned on the second hemispherical shell.

5. The portable vibration generation apparatus as defined in claim 1, further including a manually actuatable switch, the circuit board assembly responsive to actuation of the switch to select an operational mode for the motor, the circuit board assembly selectively driving the motor at a first rotational speed in a first operational mode to cause the eccentric masses to produce vibration at a first frequency, the circuit board assembly selectively driving the motor at a second rotational speed in a second operational mode to cause the eccentric masses to produce vibration at a second frequency.

6. The portable vibration generation apparatus as defined in claim 5, wherein the circuit board assembly selectively drives the motor at a third rotational speed in a third operational mode to cause the eccentric masses to produce vibration at a third frequency.

7. The portable vibration generation apparatus as defined in claim 5, wherein the operational mode is selected in response to a manually activated switch on the apparatus.

8. The portable vibration generation apparatus as defined in claim 5, wherein the operational mode is selected in response to a signal received via a wireless communication interface.

9. The portable vibration generation apparatus as defined in claim 8, wherein the wireless communication interface is a Bluetooth interface.

10. The portable vibration generation apparatus as defined in claim 1, wherein:

the first hemispherical shell and the second hemispherical shell include mating alignment features that engage to cause the first hemispherical shell and the second hemispherical shell to be mutually aligned at respective mating surfaces;

the first hemispherical shell includes a first connector support that positions the first electrical connector in a respective fixed known position in the first hemispherical shell; and the second hemispherical shell includes a second connector support that positions the second electrical connector in a respective fixed known position in the second hemispherical shell, the first connector support and the second connector support mutually aligned such that when the mating alignment features are engaged, the first electrical connector engages the second electrical connector to electrically interconnect the motor and the circuit board assembly.

11. The portable vibration generation apparatus as defined in claim 10, wherein:

the first hemispherical shell includes a power adapter jack configured to selectively receive a power adapter plug from a source of electrical energy;

the first hemispherical shell includes a third electrical connector electrically connected to the power adapter jack;

the second hemispherical shell includes a fourth electrical connector electrically connected to the circuit board assembly;

the first hemispherical shell includes a third connector support that positions the third electrical connector in a respective fixed known position in the first hemispherical shell; and the second hemispherical shell includes a fourth connector support that positions the fourth electrical connector in a respective fixed known position in the second hemispherical shell, the third connector support and the fourth connector support mutually aligned such that when the mating alignment features are engaged, the fourth electrical connector engages the third electrical connector to electrically interconnect the power adapter jack and the circuit board assembly.

12. A vibrating ball comprising:

a first hemispherical shell having a lower pole, a second hemispherical shell having an upper pole, and a polar axis extending between the lower pole and the upper pole, wherein:

the first hemispherical shell houses:

an electric motor having a shaft having a first end and a second end, the electric motor having a power input, the electric motor centered along the polar axis, the shaft perpendicular to the polar axis and positioned entirely within the first hemispherical shell;

a first eccentric mass secured to the first end of the shaft;

a second eccentric mass secured to the second end of the shaft; and a first electrical connector electrically connected to the power input of the electric motor;

the second hemispherical shell houses:

a battery centered along the polar axis;

a control circuit assembly that receives power from the battery and that generates motor control signals on a motor control output, the control circuit assembly centered along the polar axis; and a second electrical connector electrically connected to the motor control circuit to receive the motor control signals on the motor control output, the second electrical connector configured to mate with the first electrical connector;

and a plurality of fasteners to mechanically interconnect the first hemispherical shell to the second hemispherical shell, the first connector engaging the second connector when the first hemispherical shell is connected to the second hemispherical shell to electrically connect the motor control output of the motor control circuit to the power input of the electric motor.

13. The vibrating ball as defined in claim 12, wherein the first hemispherical shell includes a plurality of alignment features and wherein the second hemispherical shell includes a corresponding plurality of mating alignment features, the alignment features engaging when the first and second hemispherical shells are attached to align the first electrical connector with the second electrical connector.

14. The vibrating ball as defined in claim 12, wherein:

the first hemispherical shell includes:

a power adapter jack connectable to a source of electrical power; and a third electrical connector electrically connected to the power adapter jack;

the second hemispherical shell includes:

a fourth electrical connector electrically connected to the control circuit assembly, the fourth electrical connector configured to mate with the third electrical connector, the control circuit assembly responsive to power received from the power adapter jack via the third and fourth electrical connectors to selectively charge the battery.

15. The vibrating ball as defined in claim 12, wherein the second hemispherical shell further includes a plurality of light-emitting diodes electrically connected to the control circuit assembly, each light-emitting diode selectively activated by the control circuit assembly to indicate the status of the vibrating ball.

16. The vibrating ball as defined in claim 12, further including a first outer cover positioned over the first hemispherical shell and a second outer cover positioned over the second hemispherical shell.

17. The vibrating ball as defined in claim 16, wherein:

the first hemispherical shell and the first outer cover include respective patterns of interlocking features that inhibit movement of the first outer cover with respect to the first hemispherical shell when the first outer cover is positioned on the first hemispherical shell; and the second hemispherical shell and the second outer cover include respective patterns of interlocking features that inhibit movement of the second outer cover with respect to the second inner shell when the second outer cover is positioned on the second hemispherical shell.

18. A method for constructing a vibrating ball comprising:

securing an electric motor in a first hemispherical shell, the electric motor including a shaft having first and second end portions extending from respective first and second ends of the motor, each end portion of the shaft having a respective eccentric mass secured thereto, the electric motor electrically connected to a first electrical connector, the first electrical connector being one of a barrel jack or a barrel plug;

securing a control circuit assembly and a battery in a second hemispherical shell, the control circuit assembly electrically connected to receive power from the battery, the control circuit assembly configured to provide motor control signals to a second electrical connector, the second electrical connector being the other of the barrel jack or the barrel plug, the second electrical connector configured to selectively mate with the first electrical connector;

at least partially engaging the first electrical connector with the second electrical connector in order to align the first hemispherical shell with the second hemispherical shell; and securing the second hemispherical shell to the first hemispherical shell with the second electrical connector mated with the first electrical connector to thereby electrically interconnect the motor to the control circuit assembly.

19. The portable vibration generation apparatus as defined in claim 2, wherein:

the motor is positioned in the first hemispherical shell with a first center-of-gravity of the motor a first distance from the equatorial plane, a first product of a first mass of the motor times the first distance defining a first moment with respect to the equatorial plane;

the battery assembly and the circuit board assembly have a combined second mass and have a second center-of-gravity, the battery assembly and the circuit board assembly positioned in the second hemispherical shell with the second center-of-gravity at a second distance from the equatorial plane, a second product of the combined second mass times the second distance defining a second moment with respect to the equatorial plane, the second distance greater than the first distance, the combined second mass less than the first mass; and the first moment and the second moment are substantially balanced about the equatorial plane.

20. The vibrating ball as defined in claim 14, wherein the power adapter jack is centered along the polar axis.

* * * * *